US010113542B2

(12) United States Patent
Neoh et al.

(10) Patent No.: US 10,113,542 B2
(45) Date of Patent: Oct. 30, 2018

(54) PERISTALTIC PUMP TUBING SECURING SYSTEM

(71) Applicant: Cook Medical Technologies LLC, Bloomington, IN (US)

(72) Inventors: Wen Hong Neoh, Bloomington, IN (US); Tyson Rugenstein, Bloomington, IN (US); James Taylor, Bloomington, IN (US)

(73) Assignee: Cook Medical Technologies LLC, Bloomington, IN (US)

( * ) Notice: Subject to any disclaimer, the term of this patent is extended or adjusted under 35 U.S.C. 154(b) by 487 days.

(21) Appl. No.: 13/832,768

(22) Filed: Mar. 15, 2013

(65) Prior Publication Data

US 2013/0315763 A1 Nov. 28, 2013

Related U.S. Application Data

(60) Provisional application No. 61/651,212, filed on May 24, 2012.

(51) Int. Cl.
*F04B 43/12* (2006.01)
*F04B 43/00* (2006.01)

(52) U.S. Cl.
CPC ..... *F04B 43/0081* (2013.01); *F04B 43/12* (2013.01); *F04B 43/1261* (2013.01); *F04B 43/1284* (2013.01); *Y10T 29/49826* (2015.01); *Y10T 29/53* (2015.01)

(58) Field of Classification Search
CPC .. F04B 43/0081; F04B 43/12; F04B 43/1253; F04B 43/0072; F04B 43/0027
USPC ..... 417/477.1, 477.13, 474; D8/394–396, D8/72; D19/56, 65; D32/60–64; D28/40
See application file for complete search history.

(56) References Cited

U.S. PATENT DOCUMENTS

| | | | | |
|---|---|---|---|---|
| D34,445 | S | 4/1901 | Burkholder | |
| 1,858,284 | A | 5/1932 | Schwartz | |
| 3,807,675 | A | 4/1974 | Seckerson et al. | |
| 3,908,657 | A | 9/1975 | Kowarski | |
| 3,993,079 | A | 11/1976 | Henriques de Gatztanondo | |
| 4,029,099 | A | 6/1977 | Fifield | |
| 4,202,087 | A * | 5/1980 | Wilderman ..... | E21B 19/24 166/243 |
| 4,236,880 | A | 12/1980 | Archibald | |

(Continued)

OTHER PUBLICATIONS

IDEX Health & Science LLC Catalog, 2011-2012, Pumps Section, Cover page and pp. 104-110, downloaded from: http://www.idex-hs.com/about/data_sheets/90_Pumps_Ir.pdf.

(Continued)

*Primary Examiner* — Kenneth J Hansen
*Assistant Examiner* — Chirag Jariwala
(74) *Attorney, Agent, or Firm* — Woodard, Emhardt, Moriarty, McNett & Henry LLP

(57) ABSTRACT

Arrangements for connecting a fluid carrying tube to a peristaltic pump and/or a patient are disclosed. Arrangements that prevent the misloading of a tube in a peristaltic pump and/or misconnection of a tube to the patient that may cause a peristaltic pump to pump fluid in an undesired direction (e.g., unintentionally into or out of a patient) are also disclosed. Tubing securing clip arrangements are disclosed as well as kits comprising tubing and clips.

30 Claims, 17 Drawing Sheets

(56) References Cited

U.S. PATENT DOCUMENTS 4,392,858 A 7/1983 George et al.
4,447,235 A 5/1984 Clarke
4,585,399 A * 4/1986 Baier ..... F04B 43/1253 417/477.12
4,661,093 A 4/1987 Beck et al.
4,755,168 A 7/1988 Romanelli et al.
4,784,156 A 11/1988 Garg
4,820,265 A 4/1989 DeSatnick et al.
4,963,131 A 10/1990 Wortrich
4,966,580 A 10/1990 Turner et al.
4,976,590 A * 12/1990 Baldwin ..... 417/53
5,125,891 A 6/1992 Hossain et al.
5,213,483 A * 5/1993 Flaherty ..... A61M 5/14232 417/474
5,282,787 A 2/1994 Wortrich
5,322,422 A 6/1994 Natwick et al.
5,388,972 A * 2/1995 Calhoun et al. ..... 417/477.11
5,569,026 A * 10/1996 Novak ..... A61M 5/142 417/477.1
5,697,898 A 12/1997 Devine
5,833,667 A 11/1998 Bierman
5,911,222 A 6/1999 Lawrence et al.
5,927,951 A 7/1999 Tamari
5,927,956 A 7/1999 Lim et al.
5,928,257 A 7/1999 Kablik et al.
D420,738 S 2/2000 Carter et al.
6,319,223 B1 11/2001 Wortrich et al.
D455,337 S 4/2002 Maruoka
6,494,692 B1 * 12/2002 Green ..... F04B 43/0072 417/477.1
6,494,693 B1 12/2002 Sunden
D513,171 S 12/2005 Richardson
7,168,930 B2 1/2007 Cull et al.
7,198,751 B2 4/2007 Carpenter et al.
7,214,038 B2 5/2007 Saxer et al.
7,273,359 B2 * 9/2007 Blight ..... A61M 3/0258 417/44.2
7,291,128 B2 11/2007 Rossi et al.
7,478,999 B2 1/2009 Limoges
7,922,148 B2 4/2011 Walborn
7,980,835 B2 7/2011 LaBanco et al.
8,047,819 B2 * 11/2011 Lawrence ..... A61M 1/1037 417/476
8,052,642 B2 11/2011 Harr et al.
8,052,643 B2 11/2011 Hudson et al.
8,053,721 B2 11/2011 Bisch et al.
8,142,399 B2 3/2012 Hanlon et al.
8,142,404 B2 3/2012 Knauper et al.
8,154,274 B2 4/2012 Wiesner et al.
D661,981 S 6/2012 Melino, Sr. et al.
D675,512 S 2/2013 Gary et al.
D704,040 S 5/2014 Kosaku
D712,731 S 9/2014 Brown
8,905,730 B2 * 12/2014 Ashburn ..... A61M 5/14232 417/477.1
D748,461 S 2/2016 Catchings
D766,711 S 9/2016 Babbage
D774,880 S 12/2016 Wirth
2004/0049157 A1 3/2004 Plishka et al.
2004/0127840 A1 7/2004 Gara et al.
2005/0069437 A1 3/2005 Mittelstein et al.
2005/0118048 A1 6/2005 Traxinger
2007/0104599 A1 5/2007 Michels et al.
2007/0282268 A1 12/2007 Mayse
2008/0085200 A1 * 4/2008 Michels ..... F04B 43/1292 417/477.1
2008/0202529 A1 8/2008 Flory et al.
2009/0087327 A1 4/2009 Voltenburg, Jr. et al.
2010/0049134 A1 2/2010 Schuman, Jr.
2014/0053941 A1 * 2/2014 Belcak ..... F04B 43/0072 138/125

OTHER PUBLICATIONS

ISMATEC SA/REGLO Analog Operating Manual, 13.11.06/CB/GP, Front Cover, p. 12, Back Cover, downloaded 2013 from: http://www.ismatec.com/images/pdf/manuals/Reglo_Analog.pdf.

* cited by examiner

PERISTALTIC PUMP TUBING SECURING SYSTEM

CROSS-REFERENCE TO RELATED APPLICATIONS

This application claims the benefit of U.S. Provisional Application No. 61/651,212, filed May 24, 2012, which is hereby incorporated by reference in its entirety.

FIELD OF THE INVENTION

The present disclosure generally relates to the securing of a fluid-carrying tube to a pump; including arrangements, kits, and methods for such.

BACKGROUND

In medical care, thoracentesis and paracentesis is typically performed by hand pumping, to achieve the peristaltic movement of excess fluid in a patient's body into drainage bags for disposal or syringes for laboratory analysis or any other medical use. Hand pumping is time consuming and requires a person to be in attendance at all times. Further, the attendant must manually perform the hand pumping necessary to sustain the peristaltic movement. It is difficult to generate consistent suction forces using hand pumping. Depending upon the amount of excess fluid, hand pumping may take several hours of manual labor.

A peristaltic pump can be used for thoracentesis and paracentesis to solve at least some of the above problems. Unfortunately, tubing can be incorrectly connected to the pump, such as by having the tubing loaded into the pump in a reversed direction, causing fluid to be improperly pumped into/out of a patient. In some instances, this can lead to significant injury to the patient or death.

Additionally, some existing tube coupling systems depend on the user to hand-tighten a feature that secures the tubing to the pump. Hand-tightened connections present inconsistency in the securing of the tubing and result in some instances of the tubing being insufficiently secured and other instances of it being secured with too much force. Insufficiently secured tubing can migrate within the pump and can result in decreased pumping action and/or a tension on a section of tubing extending to or from the pump. In some instances, tension on a tubing section may result in discomfort to the patient. However, in other instances, tension on a tubing section may result in the tubing (or an attached component such as a catheter) being pulled out of a patient and/or the tubing becoming disconnected from a drainage bag. Tubing secured with too much force, on the other hand, can cause a constriction in the tubing that restricts fluid flow through the tube and decreases the efficacy of the therapy. Furthermore, too much constriction may also result in damage to the tube and/or cause a catastrophic failure (e.g., tearing the tube) when a tensile force is exerted on the tube. Thus, there is need for improvement in this field.

SUMMARY

Peristaltic pumps can be used to transport a fluid through a fluid-carrying tube in a variety of applications. For example, a peristaltic pump may be used to gradually pump nutrients or medications into a patient. Peristaltic pumps, however, may also be used for thoracentesis and paracentesis to transport excess fluid in a patient's body into drainage bags for disposal.

Oftentimes, a peristaltic pump comprises a rotor assembly having one or more rollers coupled to an axle by one or more arms. In some of these pump designs, when a fluid-carrying tube is properly loaded into the pump, a portion of the fluid-carrying tube follows a semi-circular path. When the pump is activated, a roller of the rotor assembly rotates around the axle and compresses a compressible portion of the fluid-carrying tube between the roller and a compression surface so as to cause a constriction in the fluid carrying tube. As the roller continues to rotate around the axle, the roller moves along a length of a compressible portion of the tube and compresses a portion of the tube between the roller and the compression surface, forcing a fluid contained within the tube to travel along the tube in the direction of the movement of the roller.

In some pump arrangements, the rotor assembly can rotate in a clockwise direction, a counter-clockwise direction, or both, turning in only one direction at a time. Depending on which end of the tubing is connected to the patient and how the tubing is routed through the pump, rotation of the rotor assembly in a particular direction may either deliver fluid to or withdraw fluid from the patient. For example, in some instances, a first end of the fluid-carrying tubing is connected to a patient, such as through a centesis catheter needle, and a second end of the fluid-carrying tube is connected to a drainage bag. In this instance, rotation of the rotor assembly in a first direction that moves a fluid positioned within the tube in a direction away from the first end of the tube and towards a second end of the tube can be used to withdraw fluid from the patient. Should either (1) the ends of the tube be reversed so that the second end is connected to the patient, (2) the tube be routed through the pump in the reverse direction, or (3) the rotor of the pump turn in the opposite direction, or all three of the above, the arrangement may deliver a fluid to the patient when the pump is operated.

In accordance with aspects of the present disclosure intended to avoid inadvertent withdrawal or administration of a fluid to a patient, the pump and tubing assembly is preferably arranged to limit with the association of the two configurations in which the pump will force fluid through the fluid-carrying tube in a desired direction when the pump is operated. The present disclosure also provides embodiments in which the association of the tubing with the patient is limited to one configuration, in addition or the alternative to the association of the tubing with the pump, so as to avoid inadvertent withdrawal or administration of fluid to a patient.

In some embodiments, rotation of the rotor assembly is limited to a single direction, and the association of the tubing assembly to the pump is limited to a single orientation so as to ensure that fluid is directed in a certain direction through the tubing. Various configurations of the rotor assembly and tubing are possible, with some configurations being more desirable than others for certain procedures (e.g., paracentesis and thoracentesis). For example, in a fluid withdrawing configuration, the tubing assembly and/or pump fluid may flow through a first tube portion, through a compressible tube portion positioned around the rotor assembly, and then through a second tube portion.

The tubing assembly may comprise any of a variety of components such as fluid-carrying tubing, clips, mating members, collars, quick connect/disconnect connectors, needles, and/or bags, just to name a few non-limiting examples. For example, the kit may include a centesis catheter needle, such as the Yueh Centesis Disposable Catheter Needle™ by Cook Urological, Inc. These components may be provided as a kit with portions or the entire kit provided in a sterilely sealed package. In some instances, components of the kit may be pre-assembled, pre-loaded, and/or pre-connected. For example, the clips may already be slidably coupled to the tubing with connectors at the ends of the tubing. In some embodiments, the components of the kit are selected for fluid drainage and/or fluid infusion configurations. For example, the components may be arranged so that they can only be connected to the pump and the patient in a paracentesis or thoracentesis configuration. The components of the kit may be provided in one or more sizes. For example, fluid-carrying tubing of the kit may be provided in a length of more than 1 meter. More preferably, in some instances, a fluid-carrying tube of approximately 2 or more meters in length is provided in a kit.

In some instances, portions of the tubing assembly and/or the pump comprise indicia. In some embodiments, the indicia may indicate the desired direction of fluid flow through the fluid-carrying tube. Alternatively or additionally, the indicia may indicate how the tubing assembly should be associated with the pump and/or the patient. For example, the indicia may comprise a symbol, such as a directional arrow, a geometric shape, and/or an image or silhouette of a component or patient; an alphanumeric character; and/or a color.

Corresponding indicia may be provided on both the tubing assembly and the pump so that when the tubing is properly inserted through the pump, the indicia of the tubing assembly corresponds with indicia of the pump. For example, a first clip of the tubing assembly may comprise a color that matches a color of the first mounting area arranged to receive the first clip. Alternatively, or additionally, the tubing assembly may comprise first and second clips with arrows that align with corresponding arrows on a cover of the pump when the tubing assembly is routed correctly through the pump.

In some embodiments, components of the tubing assembly may be slidably coupled to one another. For example, mating members, such as a first clip and a second clip, may be slidably coupled to the fluid-carrying tube such that the distance between each clip and the adjacent end may be adjusted. Advantageously, slidably coupling portions of the tubing assembly, such as clips and/or collars, can allow a medical professional to adjust the length of tubing extending between the patient and the pump and/or the pump and the collection receptacle (e.g., a drainage bag). This can reduce excess tubing that can become tangled, kinked, and/or obtrusive to the patient and/or medical professional. Additionally, adjusting the positioning of components of the tubing assembly can allow for more liberty in the positioning of the pump with respect to the patient. Adjustable components, such as clips, can also reduce and/or eliminate the time consuming and additional step of cutting the fluid-carrying tubing, such as to reduce the amount of excess length.

In some instances, an adhesive may be used to secure components of the tube assembly to the fluid carrying tube and/or to one another. For example, once the first and second clips of the fluid carrying tube are positioned in the desired locations along the length of the fluid-carrying tube, an adhesive may be applied, uncovered, and/or activated so as to selectively adhere at least one of the first and second clips to the surface of the fluid carrying tube. In some instances, the adhesive is a two-part adhesive and/or is activated by the addition and interaction with another material (e.g., water or air) so that the adhesive cures and adheres the component, such as a clip, to a surface of the fluid carrying tube.

As will be appreciated by those of ordinary skill in the art, components of the tubing assembly may be selectively adhered to one another and/or to the fluid-carrying tube in any number of ways. For example, heat bonding may be used to heat a portion of a clip and/or a portion of the fluid-carrying tube so that the two become joined. Alternatively or additionally, portions of the clip and/or fluid-carrying tube may be arranged to cause an interference fit and/or a friction fit between the two.

In some embodiments, at least one mating member, such as first mating member, comprises a sensor detectable feature that is detectable by at least one sensor of the peristaltic pump. Preferably, the sensor(s) of the peristaltic pump and the sensor detectable feature(s) of the mating member(s) are arranged so that the pump will not operate if the mating member(s) is/are not properly connected to the pump. Advantageously, this can prevent the operation of the pump with improperly installed and/or secured tubing. For example, the sensor of the pump can be connected to control circuitry of the pump so that if the sensor does not detect the sensor detectable feature of the clip, the pump will not operate. If the sensor of the pump detects the sensor detectable feature, the control circuitry of the pump will allow the pump to operate (e.g., the rotor assembly to rotate the rollers).

As will be appreciated, one or more sensors may be used to detect one or more sensor detectable features of one or more mating members. For example, the control circuitry of the pump may be arranged so that the pump will not operate if fewer than a predetermined number of the sensors detect sensor detectable features. For example, the control circuitry of the pump may be arranged so that the pump will not operate if fewer than all of the sensors detect sensor detectable features. Alternatively or additionally, the pump may be arranged to not perform pumping operations if fewer than a predetermined number of particular sensors do not detect sensor detectable features. For example, a first sensor or group of sensors may be arranged to detect one or more sensor detectable features of a first clip and a second sensor or group of sensors may be arranged to detect one or more sensor detectable features of a second clip; and if fewer than a predetermined number of sensors of the first group and/or second group individually do not detect sensor detectable features, the pump will not perform pumping operations.

The sensors and associated sensor detectable features may comprise any arrangement that facilitates the mechanical, electrical, and/or optical detection of sensor detectable feature(s) by the associated sensor(s). For example, a toggle switch may be used to detect a protrusion of a clip, with the protrusion activating and/or deactivating the toggle switch. Alternatively or additionally, the first clip may comprise a magnet that cooperates with a magnetic switch of the pump when the first clip is properly inserted into a first clip holder.

As will be appreciated, the detection of the sensor detectable feature (e.g., the activation of a toggle switch) may be arranged to complete or break an electrical circuit of the pump. Other sensor and sensor detectable feature arrangements are contemplated, such as an optical sensor detecting an optical feature of a clip, a electrical contact of a clip completing an electrical circuit of the pump, a magnetic feature magnetically actuating a magnetic switch, and/or a physical feature of a clip actuating a mechanical switch of the pump, just to name a few non-limiting examples.

Other portions of the peristaltic pump and/or tubing assembly may comprise sensors and sensor detectable features. For example, the pump may comprise a cover for the rotor assembly, the cover comprising a magnet that cooperates with a magnetic switch of the pump and control circuitry of the pump so that pumping operations will not be performed unless the cover is properly attached to the pump.

In some instances, when the fluid-carrying tube is coupled to the pump with mating members, such as clips, portions of the mating members and/or the pump may deflect one or more portions of the fluid-carrying tube. For example, a first clip holder may have a tube deflecting portion that cooperates with a first clip to contort and/or compress the fluid-carrying tube when the first clip retaining the fluid carrying tube is received in the first clip holder. Advantageously, compression and/or contortion of the fluid-carrying tube can aid in preventing migration of the fluid-carrying tube during pumping operation and/or under non-pumping force exerted onto a component of the tube assembly, e.g., the fluid-carrying tube and/or a clip.

In some embodiments, the cooperation of two or more portions of the tubing assembly and/or a portion of the tubing assembly and the pump is arranged so as to cause a predetermined amount of compression and/or contortion of the fluid-carrying tube. Advantageously, this can provide improved consistency in the securing of the fluid-carrying tube to the peristaltic pump, which may decrease the likelihood of migration of the fluid-carrying tube and/or decreased pumping operation.

In some instances, components of the tubing assembly positioned at the ends of the tubing, such as end connectors, can have portions arranged to contact an inner surface of the fluid-carrying. Preferably, these portions are arranged to resist removal of the component from the end of the fluid-carrying tube. For example, a connector may have a barbed portion comprising a plurality of frusto-conical segments of similar or different sizes. When the barbed portion is inserted into the lumen of the fluid carrying tube, the frusto-conical segments contact the inner surface.

In some instances, the component, such as a connector, contacting an inner surface of the fluid-carrying tube radially expands a portion of the tube so that the maximum outer dimension of the fluid-carrying tube is greater than other portions of the fluid-carrying tube. In some instances, an end component enlarges the maximum outer dimension of the fluid-carrying tube a sufficient amount to prevent removal of one or more other components positioned on the fluid-carrying tube over the end component.

In some tubing assembly embodiments comprising an end component (e.g., a barbed connector) with a portion extending into the lumen of the fluid-carrying tube, a securing collar may be positioned on the outside of the fluid-carrying tube. Preferably, the securing collar and end component may be arranged to compress the fluid-carrying tube between the securing collar and the end component when the securing collar and end component are radially aligned. In many instances, the securing collar and end component are arranged to compress the fluid-carrying tube when the collar and end component are both radially and coaxially aligned. Advantageously, a securing collar may increase the interference and/or frictional resistance between the fluid-carrying tube and the end component (e.g., a barbed connector). Increased resistance between the fluid-carrying tube and an end component such as a connector may be beneficial in high pressure configurations and/or uses.

In some embodiments, an end component, such as an end connector (e.g., a barbed connector) has a portion arranged to fluidly connect the fluid-carrying tube with another device such as a catheter, needle, and/or bag, just to name a few non-limiting examples. In some instances, an end connector of the tubing assembly is arranged to connect with one component (e.g., a centesis needle) and not another (e.g., a bag). Additionally, some tubing assembly arrangements comprise at least two end connectors, with each arranged to connect to a component that the other is not.

In certain aspects, the present disclosure provides arrangements that effectively prevent the incorrect loading of a fluid-carrying tube in a peristaltic pump and/or the incorrect attachment of a pump to a patient. In accordance with some forms of the disclosure, such arrangements include specific portions of a peristaltic pump and/or a tubing assembly that are arranged to prevent the attachment of the fluid-carrying tube to the peristaltic pump in an undesired orientation.

The present disclosure teaches, in some embodiments, a peristaltic pump, comprising a rotor assembly and a mounting arrangement associated with the rotor assembly; the mounting arrangement having a first mounting area and a second mounting area; the first mounting area being mateable with a first mating member; and the second mounting area being mateable with a second mating member; wherein the first and second mating members are arranged to retain a fluid-carrying tube; and wherein the first mounting area is arranged to prevent the first mounting area from mating with the second mating member. In some embodiments the first mounting area has a stop member that prevents the first mounting area from mating with the second mating member. Similarly, in some embodiments, the second mounting area is arranged to prevent the second mounting area from mating with the first mating member. Some instances can also have a stop member in the second mounting area that prevents the second mounting area from mating with the first mating member.

The present disclosure also teaches a kit useful for operably coupling a tube with a peristaltic pump having first and second mounting areas, the kit comprising a first mating member having a first tube retaining area and a first mating area arranged to mate with a first mounting area of a peristaltic pump; a second mating member having a second tube retaining area and a second mating area arranged to mate with a second mounting area of the peristaltic pump; the first and second tube retaining areas arranged to retain a fluid-carrying tube; and the first mating area having an arrangement that prevents the first mating area from mating with the second mounting area of the peristaltic pump. In some instances, a flange in the first mating area prevents mating with the second mounting area. In some embodiments, the second mating area also has an arrangement that prevents the second mating area from mating with the first mounting area of the peristaltic pump. And in other instances, the tube retaining area has a portion with an inner dimension that is smaller than a maximum outer dimension of the fluid-carrying tube so as to cause an interference fit.

The present disclosure provides, in-part, an assembly comprising a peristaltic pump having a rotor assembly, a compression surface associated with the rotor assembly, and a first and a second mounting area; a tube retaining member that is attachable and detachable from the first and the second mounting areas of the pump and arranged to retain a fluid-carrying tube; and the pump arranged to receive the fluid-carrying tube between the rotor assembly and the compression surface when the tube retaining member is attached. In some embodiments, the tube retaining member is attachable to the peristaltic pump in only one orientation.

Additionally, the present disclosure provides a method of attaching a fluid-carrying tube to a peristaltic pump, comprising positioning a portion of a fluid-carrying tube around a rotor of a peristaltic pump; mating a first mating member with a first mounting area of the peristaltic pump; and mating the second mating member with a second mounting area of the peristaltic pump so as to attach the fluid-carrying tube to the peristaltic pump; wherein each mating member is not mateable with the other mounting area.

The present disclosure also provides for tubing to be snapped or locked in relation to the pump in a specific way so that fluid flows in an intended direction through the tubing. In some embodiments, it does this by using a pair of clips positioned on the tubing, the clips having arrangements that correspond with particular mounting areas on the peristaltic pump. In some embodiments, the mounting areas on the peristaltic pump are designed to mate with a specific clip, either the distal or proximal clip to the patient. In this way, the arrangement resists the incorrect loading of the tubing. Similarly, the clips and/or mounting areas can be color coded so as to aid the user in identifying which clips and mounting areas correspond with one another.

In some embodiments, the clip and/or mounting area arrangements are configured such that when the tubing is secured to the pump, the tubing is secured with a predetermined force. This predetermined force resists migration of the tubing during pump use. A clip used to secure the tubing can have a feature on it that compresses the tubing slightly and therefore resists the clip from moving from its relative position on the tubing. Additionally, the clip can be designed so that, when the clip is mounted in the mounting area of the pump, the tubing is contorted between the clip and the mounting area so that migration of the tubing and/or clip(s) is resisted.

As will be appreciated by those of ordinary skill in the art, components of the present disclosure, such as the tubing assembly, can be constructed of any suitable material. For example, the first clip and the second clip may be made of metal, such as stainless steel, or of a polymer such as nylon, PVC, polyethylene, and/or polypropylene, to name a few non-limiting examples. In some instances, a combination of materials may be used to construct the first clip and/or the second clip. For example, a flexible portion of the clip may be made of metal while a display surface is made of a plastic.

Similarly, the first clip and the second clip may be formed by any suitable process. For instance, if the first clip and the second clip are made of plastic, these components may be made by injection molding or injection compression molding, just to name a few non-limiting examples.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
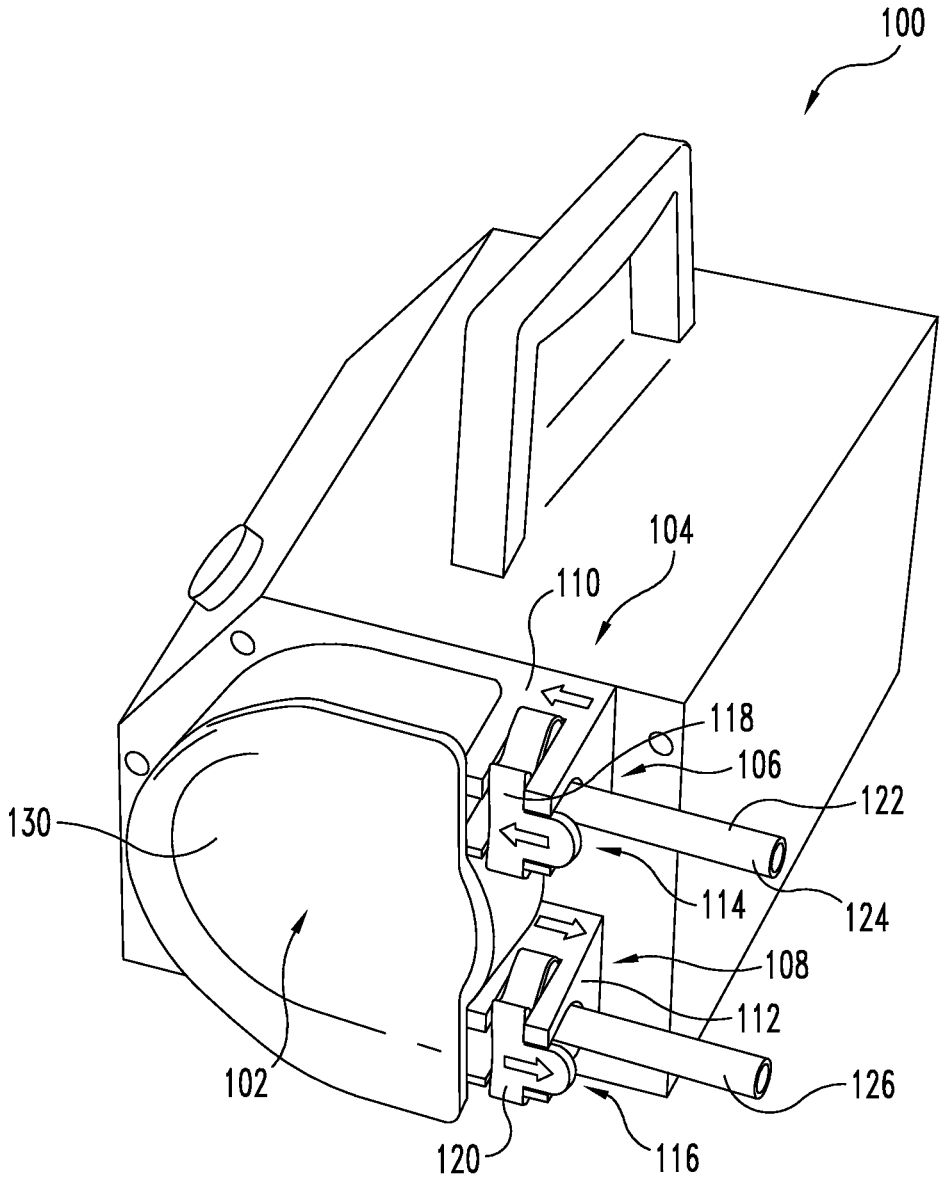
FIG. 1 is a perspective view of a peristaltic pump.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail; although it will be apparent to those skilled in the relevant art that some features that are not relevant to the present invention can not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will likely first appear in FIG. 1, an element identified by a "200" series reference numeral will likely first appear in FIG. 2, and so on.

Figure 2:
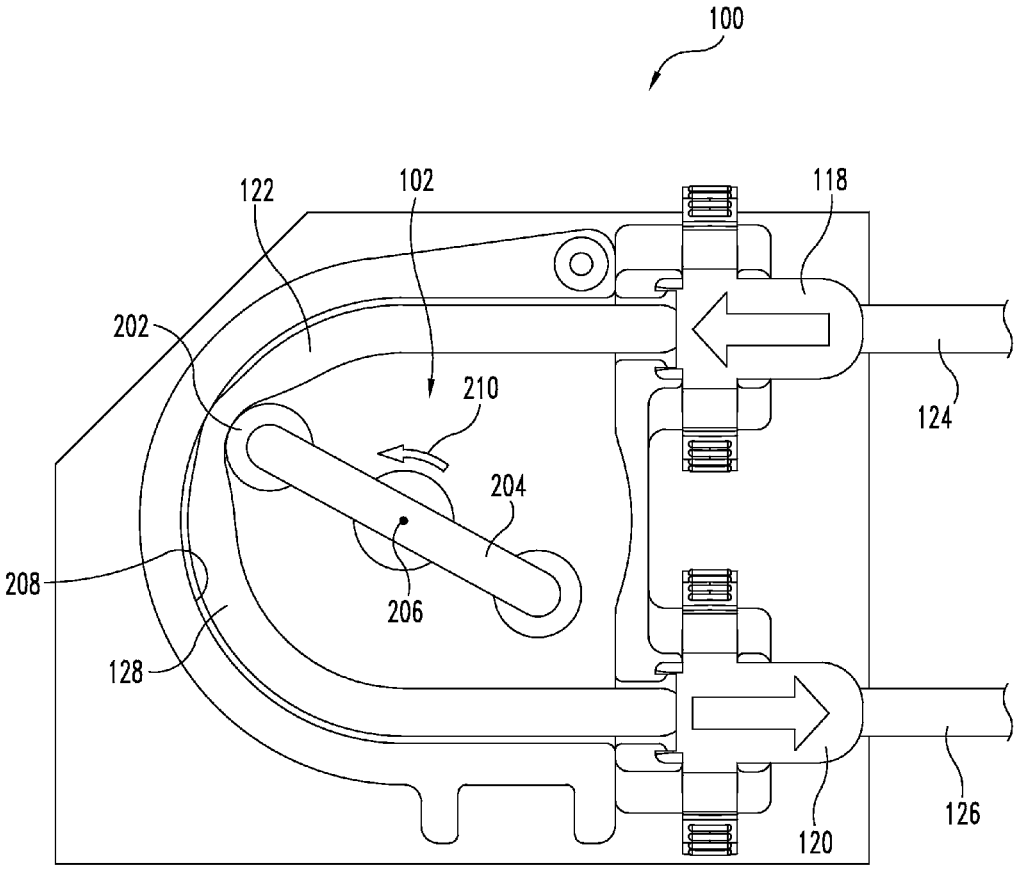
FIG. 2 is a side view of a peristaltic pump.

FIGS. 1 and 2 illustrate an exemplary peristaltic pump 100 having a rotor assembly 102 and a mounting arrangement 104. In some applications, the peristaltic pump 100 has a cover 130 positioned over the rotor assembly 102. The cover 130 can protect against the intrusion of foreign objects that can impact the operation of the rotor assembly 102 and/or the peristaltic pump 100.

The mounting arrangement 104 can comprise of a first mounting area 106 and a second mounting area 108. The first mounting area 106 can be arranged to receive a first mating member 114, and the second mounting area 108 can be arranged to receive a second mating member 116. In some embodiments, the first mounting area 106 is arranged to mate with the first mating member 114 and not mate with the second mating member 116. Similarly, the second mounting area 108 can be arranged to mate with the second mating member 116 and not with the first mating member 114. Alternatively or in addition, the first mating member 114, as opposed to the first mounting area 106, can be arranged to mate with the first mounting area 106 and not mate with the second mounting area 108. Similarly, the second mating member 116 can be arranged to mate with the second mounting area 108 but not with the first mounting area 106.

In some instances, the first mounting area 106 includes a first clip holder 110 and the second mounting area 108 includes a second clip holder 112. Similarly, a first mating member 114 can be arranged as a first clip 118, and a second mating member 116 can be arranged as a second clip 120. In these instances, the first clip holder 110 and the first clip 118 can be arranged to mate with one another and the second clip holder 112 and the second clip 120 can be arranged to mate with one another.

The peristaltic pump 100 is arranged to receive a fluid-carrying tube 122. The fluid-carrying tube 122, when installed in the peristaltic pump 100, follows a path with a first tube portion 124 passing through the first mating member 114 (e.g., first clip 118) and/or the first mounting area 106 (e.g., first clip holder 110) and a second tube portion 126 passing through the second mating member 116 (e.g., second clip 120) and/or the second mounting area 108 (e.g., second clip holder 112). The fluid-carrying tube 122 has a third tube portion 128 (shown in FIG. 2) extending between the first tube portion 124 and the second tube portion 126 and 8 extending around the rotor assembly 102 of the peristaltic pump 100 when the fluid-carrying tube 122 and/or the first mating member 114 and second mating member 116 are connected to the peristaltic pump 100.

FIG. 2 illustrates a side-view of the peristaltic pump 100 shown in FIG. 1 without cover 130. The rotor assembly 102 may comprise one more rollers 202 coupled to an axle 206 by at least one arm 204. Preferably, the rollers 202 are rotationally coupled to the arm 204. As axle 206 rotates, arm 204 moves roller 202 along a length of a compressible portion of the fluid-carrying tube 122, such as third tube portion 128, to compress portions of the compressible portion between a compression surface 208 of the peristaltic pump 100 and one or more rollers 202.

The rotor assembly 102 can rotate in a clockwise or a counter-clockwise direction. Depending on which end of the tubing is connected to the patient, rotation of the rotor assembly 102 in a particular direction may either deliver fluid to or withdraw fluid from the patient. For example, in some instances, rotation of rotor assembly 102 in a first direction delivers fluid to a patient and rotation in a second direction withdraws fluid from a patient. In other instances, the rotor assembly 102 rotates in one direction and whether the peristaltic pump 100 delivers or withdraws fluid to/from a patient depends on the orientation of the tubing. Perferably, the tubing and/or connectors are arranged with respect to the patient and the peristaltic pump 100 such that the fluid flows in the desired direction through the tubing when peristaltic pump 100 is operated. In can be beneficial to restrict the rotation of the rotor assembly to a single direction and the attachment of the tubing in a single orientation so as to ensure that fluid is directed in a certain direction. Various configurations of the rotor assembly and tubing are possible, with some configurations being more desirable than others for certain procedures (e.g., paracentesis and thoracentesis).

For example, in a fluid withdrawing configuration, fluid may flow through the first tube portion 124, through the third tube portion 128 around the rotor assembly 102, and then through the second tube portion 126. In this configuration, the rotor assembly 102 rotates in a counter-clockwise direction indicated by the arrow 210. Additionally, indicia shown on the first clip 118 and the second clip 120 can indicate the direction of fluid flow so as to aid in the correct loading of the fluid-carrying tube 122 in the peristaltic pump 100 and/or the proper connection of the fluid-carrying tube 122 to the patient.

Figure 3:
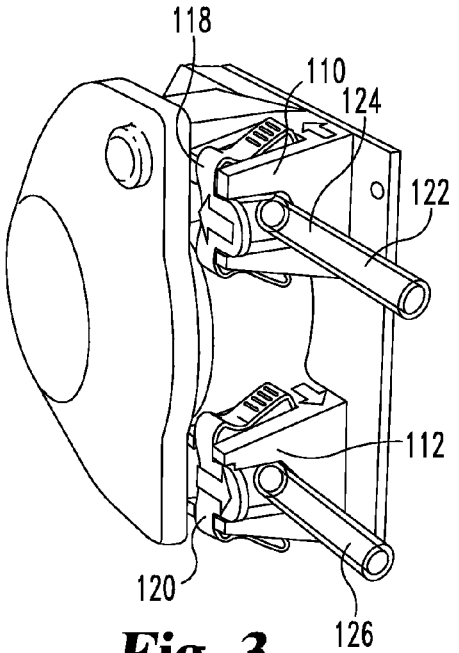
FIG. 3 is a perspective view of one end of a peristaltic pump.

FIG. 3 illustrates a perspective view of one end of a peristaltic pump 100 with a first clip 118 mating with a first clip holder 110 and a second clip 120 mating with a second clip holder 112. As illustrated in FIG. 3, a first tube portion 124 and a second tube portion 126 of a fluid-carrying tube 122 are retained by a first clip 118 and a second clip 120 in mating connection with a first clip holder 110 and a second clip holder 112.

Figure 4:
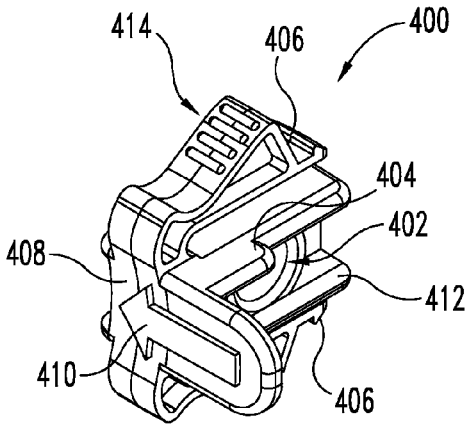
FIG. 4 is a perspective view of a clip.

FIG. 4 illustrates a perspective view of one embodiment of a first clip. The first clip 400 can have a tube receiving area 402 arranged to receive a portion of the fluid-carrying tube 122. The first clip 400 can also have a flange 404, a catch 406, a display surface 408, an indicia 410, a guide portion 412, and a flexible portion 414. The flange 404 can be arranged to abut a stop surface (not shown in FIG. 4) of a first clip holder 110 and/or a second clip holder 112 such as those shown in FIG. 1 so as to prevent the first clip 400 from being inserted in an undesired orientation in the first clip holder 110 and/or to prevent the first clip 400 from being inserted in the second clip holder 112.

The catch 406 of the first clip 400 can be arranged to lock the first clip 400 into a first clip holder 110. Flexible portion 414 can be a deflectable tab member and/or arm having the catch 406 mounted thereon so as to permit a user to deflect the catch 406 into or out of a locking position when the first clip 400 is inserted or withdrawn from the first clip holder 110 on the peristaltic pump 100. In some instances, the flexible portion 414 has a bias, such as a spring bias, towards the surface having the catch 406. In such instances, the flexible portion 414 may deflect away from the surface having the catch 406 when the first clip 400 is being inserted into a first clip holder 110, and then the flexible portion 414 may deflect towards the surface having the catch 406 when the first clip 400 is inserted, so as to lock the catch 406 into engagement with the first clip holder 110.

The display surface 408 can face outwardly of the peristaltic pump 100 so as to present the display surface 408 towards a user of the peristaltic pump 100. In some instances the display surface 408 can include indicia 410 such as an arrow indicating the direction of fluid flow through the fluid-carrying tube retained by the first clip 400 and attached to the peristaltic pump 100. The indicia 410 may include alphanumeric characters and/or symbols. Additionally, the indicia 410 may be presented in various colors. In some embodiments, the display surface 408 may match with a surface of the first clip holder 110. For instance, the display surface 408 and first clip holder 110 may be of a similar color and/or have similar markings.

The guide portion 412 of the first clip 400 can include a surface arranged to guide the insertion of the first clip 400 into the first clip holder 110. In some instances, the guide portion 412 may align the first clip 400 and/or the first clip holder 110 for mating contact. For example, the guide portion 412 may be received into a recess of the first clip holder 110 and/or slide along a surface of the first clip holder 110. The guide portion 412 can also be arranged to support a flange 404 on a surface thereof.

Figure 5:
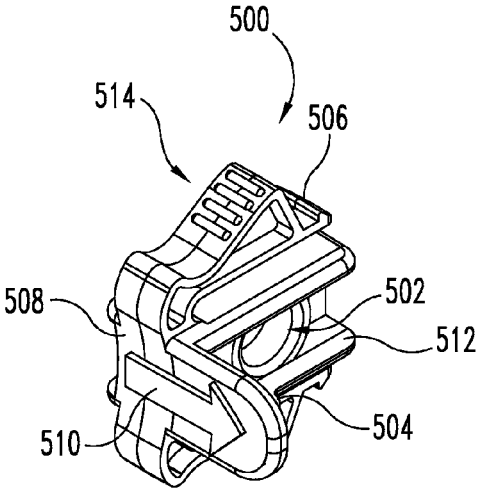
FIG. 5 is a perspective view of a clip.
Figure 6:
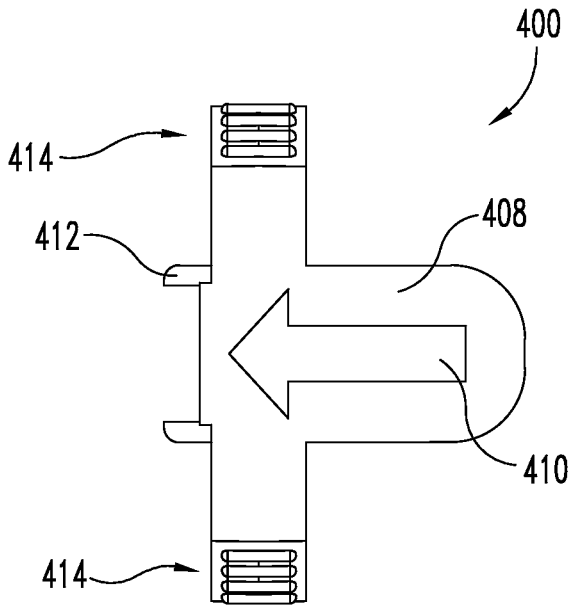
FIG. 6 is a front view of a clip.

FIG. 5 illustrates a perspective view of a second clip 500. Similar to the first clip 400 shown in FIG. 4, the second clip 500 can include a tube receiving area 502 arranged to receive a fluid-carrying tube 122, a flange 504, a catch 506, display surface 508, indicia 510, a guide portion 512, and a flexible portion 514.

The second clip 500 can be arranged such that the flange 504 is positioned in a different location than the flange 404 of the first clip 400. The flange 504 of the second clip 500 can be arranged such that the flange 504 contacts a stop surface (not shown in FIG. 5) of a first clip holder 110 and/or second clip holder 112 so as to prevent the second clip 500 from being inserted in an undesired orientation in the second clip holder 112 and/or from being inserted in the first clip holder 110.

FIGS. 6, 7, 8, and 9 illustrate a front view of one embodiment of a first clip 400. The first clip having flexible portions 414 extending away from a central portion and having a display surface 408 with indicia 410. The flexible portions 414, such as deflectable tab members and/or arms, can extend in a direction transverse to the direction that the fluid-carrying tube travels through the receiving area 402 of the first clip 400.

The one or more guide portions 412 can be disposed inward of the flexible portions 414 and arranged to align the first clip 400 with a first clip holder 110. Alternatively, the guide portions can be disposed outward of the flexible portions 414. In some embodiments, the guide portions 412 are positioned on the flexible portions 414.

The display surface 408 can also be used similar to that of a flange 404, and/or be positioned on the flange 404, so as to prevent the first clip 400 from being inserted in an undesired orientation in a first clip holder 110 and/or from being inserted in a second clip holder 112. In some embodiments, the display surface 408 extends in a direction transverse to the plane in which the first clip 400 is inserted into the first clip holder 110. In some instances, this may improve the presentation and/or orientation of the display surface 408 towards a user.

Figure 7:
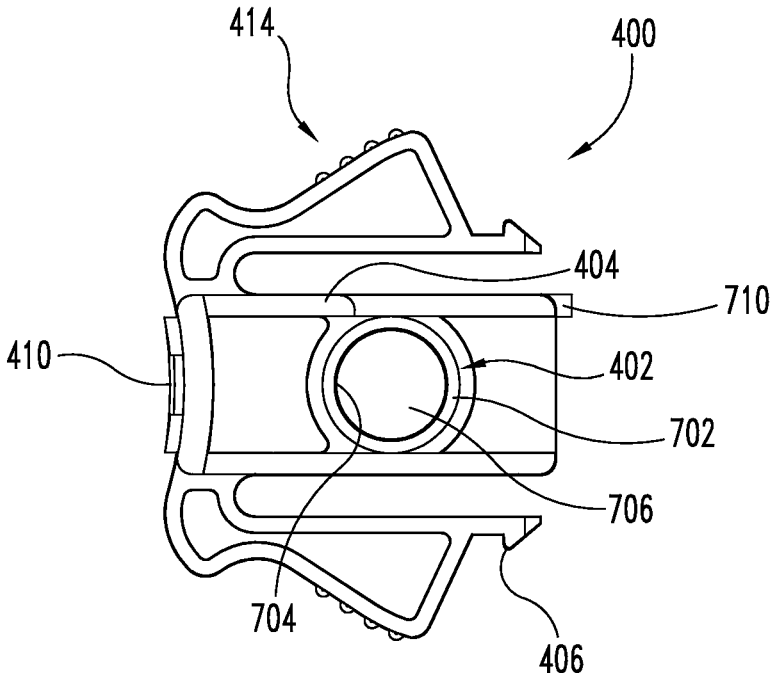
FIG. 7 is a side view of a clip.

FIG. 7 illustrates a side view of an embodiment of a first clip 400. The tube receiving area 402 of the first clip 400 can have a tube-aligning surface 702. The tube-aligning surface 702 can help align the fluid-carrying tube 122 with a recess 706 defined by a surface 704 of the first clip 400. For example, as a fluid-carrying tube 122 is being advanced towards the recess 706, a portion of the fluid-carrying tube 122 may contact the tube-aligning surface 702 and help align the tube with the recess 706.

In some embodiments, the first clip 400 and/or the second clip 500 can be slidably coupled to the fluid-carrying tube 122. The surface 704 can be arranged to slidably couple the fluid-carrying tube 122 to the first clip 400. Additionally, the recess 706 can be arranged to receive a fluid-carrying tube 122 and retain it within the body of the first clip 400. In some embodiments, the surface 704 defining the recess 706 can be slanted such that the recess 706 has a slight draft. This slight draft can cause an interference fit and/or increased friction fit with the fluid-carrying tube 122 so as to secure the fluid-carrying tube 122 within the first clip 400 and keep the first clip 400 from sliding over an end portion and/or connector of the fluid-carrying tube 122.

In some embodiments, the surface 704 substantially surrounds the fluid-carrying tube 122 so as to resist the removal of the fluid-carrying tube 122 from the recess 706. For example, the surface 704 may substantially and/or completely surround the circumference of the fluid-carrying tube 122 so as to resist the fluid-carrying tube 122 from being removed from the first clip 400 in a direction transverse to the path that the fluid-carrying tube 122 follows through the recess 706. Similarly, the surface 704 may capture the fluid-carrying tube 122 sufficiently such that the fluid-carrying tube 122 may only be slidably removed in a direction along the path that the fluid-carrying tube 122 follows through the recess 706 defined by the surface 704 of the first clip 400.

A slidable connection between the fluid-carrying tube 122 and the first clip 400 and/or the second clip 500 may allow for the slidable adjustment of the first clip 400 and/or second clip 500 along the length of the fluid-carrying tube 122. For example, a physician may wish to locate the peristaltic pump 100 closer to the body of the patient but not have an excess length of fluid-carrying tube 122 extending between the patient and the peristaltic pump 100. The slidable connection between the fluid-carrying tube 122 and the first clip 400 and the second clip 500 would allow the physician to adjust the position of the first clip 400 and the second clip 500 along the length of the fluid-carrying tube 122 before mating the first clip 400 and the second clip 500 to the peristaltic pump 100. This arrangement would allow the physician to adjust the length of the fluid-carrying tube 122 extending between the peristaltic pump 100 and the patient when the fluid-carrying tube 122, first clip 400, and second clip 500 are connected to the peristaltic pump 100.

In some embodiments, a mating member, such as first mating member 114, may comprise a sensor detectable feature that is detectable by a sensor of the peristaltic pump 100. For example, first clip 400 may comprise a sensor detectable feature, such as protrusion 710, on a portion of the first clip 400 that is adjacent to and/or contacting the peristaltic pump 100 when the first clip 400 is coupled with the first clip holder 112.

Figure 8:
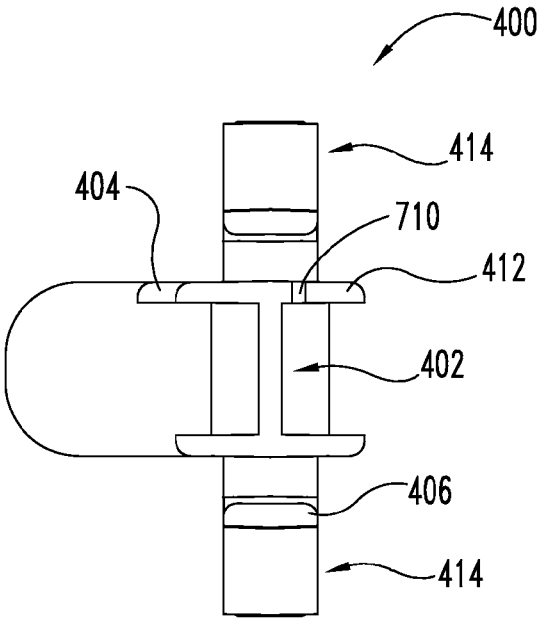
FIG. 8 is a back view of a clip.
Figure 9:
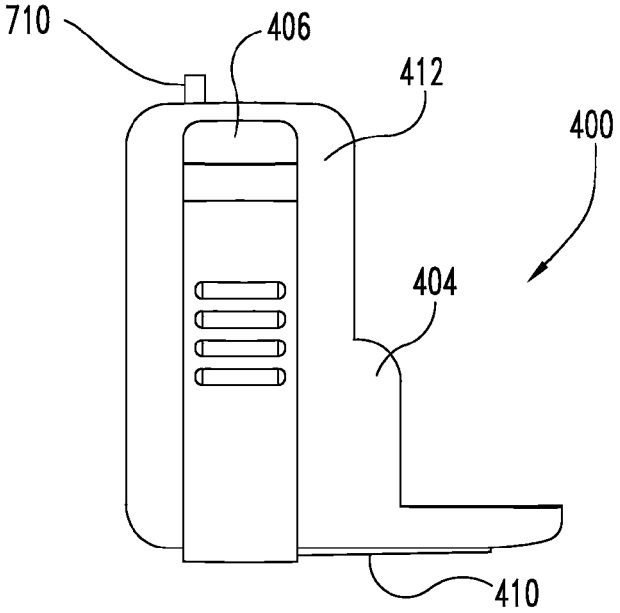
FIG. 9 is a top view of a clip.

The sensor detectable feature, such as protrusion 710, in some instances is positioned on a surface of the pump 100, such as on guide portion 412 as illustrated in the FIGS. 8 and 9. Alternatively, an existing feature of the mating member, such as first clip 400, may also serve as the sensor detectable feature. For example, catch 406 may serve as the sensor detectable feature and/or flange 404 may serve as the sensor detectable feature.

Figure 10:
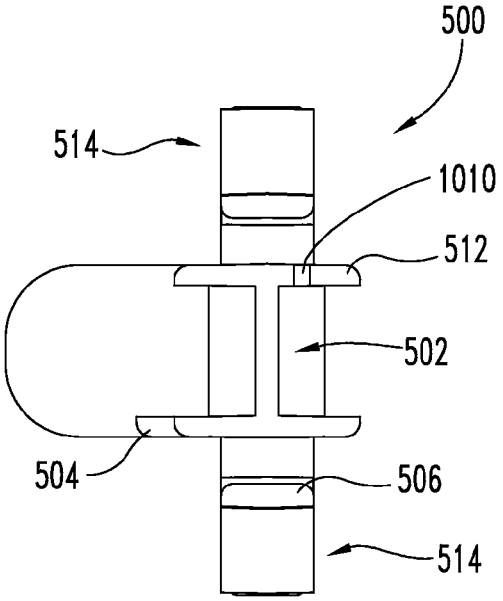
FIG. 10 is a back view of a clip.
Figure 11:
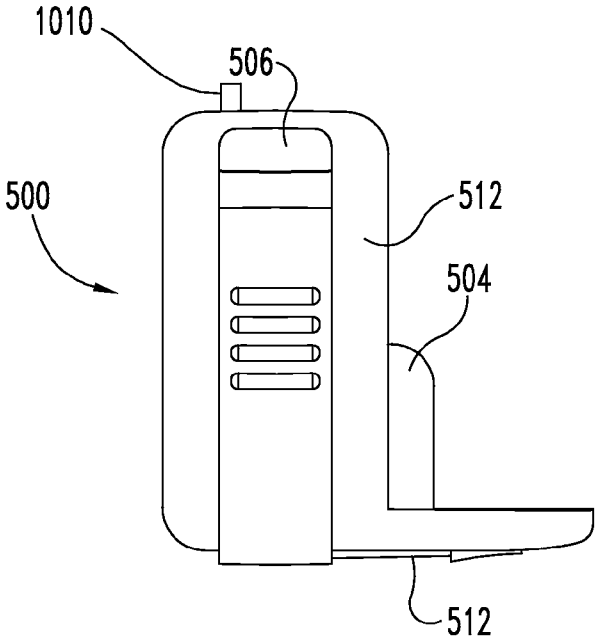
FIG. 11 is a top view of a clip.

FIG. 10 illustrates a back view and FIG. 11 illustrates a top view of a second clip 500, the second clip 500 having a flange 504 positioned in a different position than the flange 404 of the first clip 400. In some embodiments, the flange 504 of the second clip 500 is positioned below the tube receiving area 502, wherein the flange 404 of the first clip 400 is positioned above the tube receiving area 402. In some instances, second clip 500 also comprises a sensor detectable feature 1010, like sensor detectable feature 710 of first clip 400. Sensor detectable feature 1010 may be arranged to be detected by the same or a different sensor than that which detects the sensor detectable feature 710 of the first clip 400.

Figure 12:
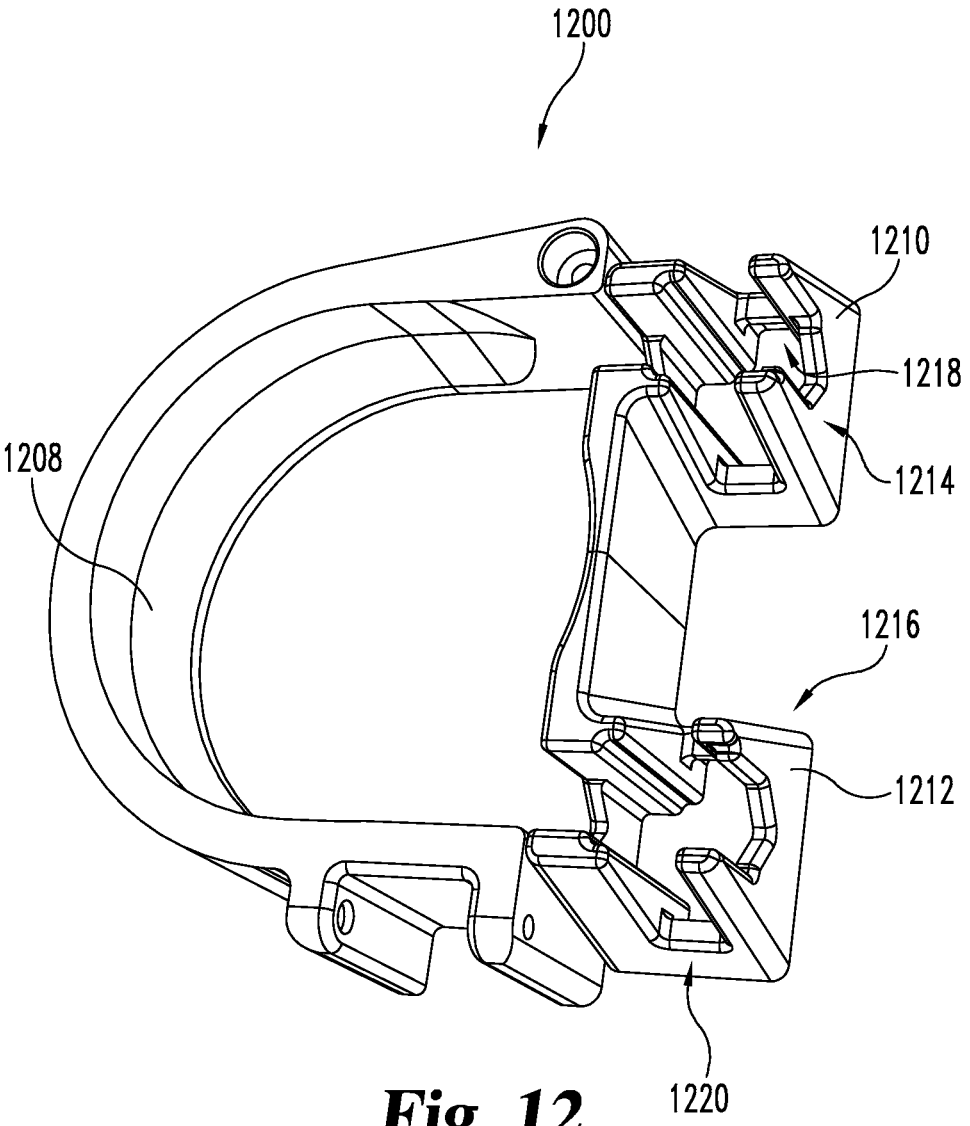
FIG. 12 is a perspective view of a portion of a peristaltic pump.

FIG. 12 illustrates a perspective view of a portion 1200 of a peristaltic pump 100. The pump portion 1200 having a compression surface 1208 arranged to have a fluid-carrying tube 122 compressed against it by a roller 202 of a rotor assembly 102. When a fluid-carrying tube 122 is loaded into a portion 1200 of a peristaltic pump 100, the fluid-carrying tube 122 follows a semi-circular path along the inside of the compression surface 1208, the path of the fluid-carrying tube 122 positioning the fluid-carrying tube 122 between the compression surface 1208 and a roller 202 of the rotor assembly 102.

The pump portion 1200 can also comprise a first clip holder 1210 and a second clip holder 1212. In some embodiments, the first clip holder 1210 has a first stop member 1214 and/or the second clip holder 1212 has a second stop member 1216. In some instances, the first stop member 1214 is positioned in a different location than the second stop member 1216 relative to an inserted clip (such as first clip 400 and/or second clip 500) so as to prevent one or more clips from being inserted into the clip holder in an undesired orientation and/or in any orientation. In other instances the first stop member 1214 and the second stop member 1216 are positioned in similar locations in the mounting areas and the clips (such as first clip 400 and/or second clip 500) have features that are different than one another so as to resist the insertion of a clip in the incorrect orientation and/or in the incorrect clip holder (such as first clip holder 1210 and/or second clip holder 1212).

Additionally, the first clip holder 1210 can have a first locking area 1218. The first locking area 1218 on the first clip holder 1210 arranged to receive a catch 406 of a first clip 400 so as to lock the first clip 400 into a mating position with the first clip holder 1210. Similarly, the second clip holder 1212 can have a second locking area 1220. The second locking area 1220 on the second clip holder 1212 arranged to receive a catch 506 of the second clip 500 so as to lock the second clip 500 into a mating position with the second clip holder 1212.

Figure 13:
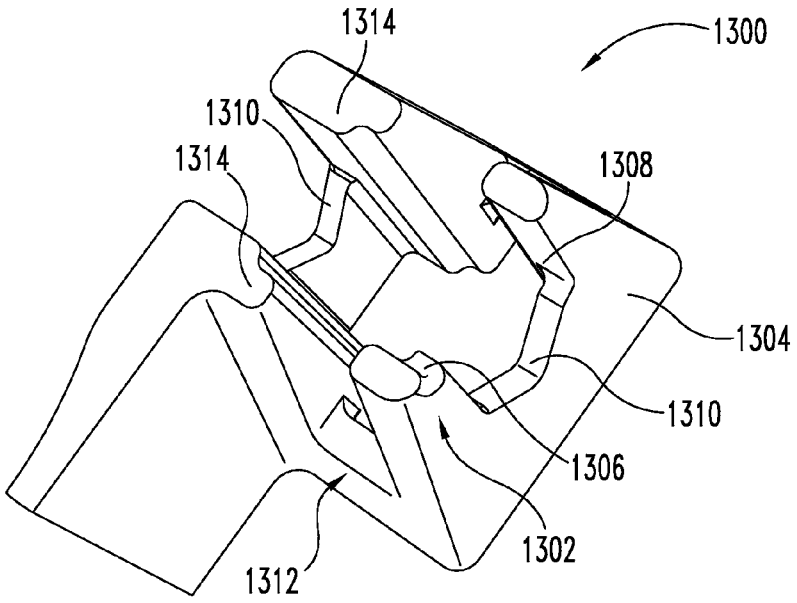
FIGS. 13 and 14 are perspective views of clip holders

FIG. 13 is a perspective view of a first clip holder 1300. The first clip holder 1300 has a first stop member 1302 defined by a wall portion 1304. The first stop member 1302 can comprise a stop surface 1306 arranged to contact a flange portion of a second clip 500 and thus prevent loading of the second clip 500 into the first clip holder 1300.

The wall portion 1304 of the first clip holder 1300 can define a flange receiving recess 1308 arranged to receive the flange 404 of a first clip 400 so as to permit the first clip 400 to mate with the first clip holder 1300. The wall portion 1304 may also have one or more surfaces arranged to receive a guide portion (such as guide portion 412 of the first clip 400) when the clip is inserted. The surfaces may be arranged to contact the guide portion and align and/or maintain alignment of the guide portion and/or the clip with the first clip holder 1300.

In some embodiments, the first clip holder 1300 can comprise a locking area 1312 arranged to cooperate with a catch 406 of a first clip 400 so as to lock the first clip 400 in mating connection with the first clip holder 1300. Additionally, the first clip holder 1300 can have a stop surface 1314 arranged to contact the flange 404 of the first clip 400 and/or the flange 504 of the second clip 500 so as to prevent either clip from being loaded in an undesired orientation, such as a rotated orientation, in the first clip holder 1300.

The wall portion 1304 of the first clip holder 1300 can define a tube receiving area 1310. Tube receiving area 1310 can be arranged to receive a fluid-carrying tube 122 and/or provide access for a fluid-carrying tube 122 to the recess 706 of a first clip 400. In some embodiments the tube receiving area 1310 follows the profile of the fluid-carrying tube 122. In other embodiments the tube receiving area 1310 has a v-shaped boundary. In some instances, a portion of clip holder 1300, such as the portion defining tube receiving area 1310, is arranged to deflect and/or contort a portion of the fluid-carrying tube 122.

Figure 14:
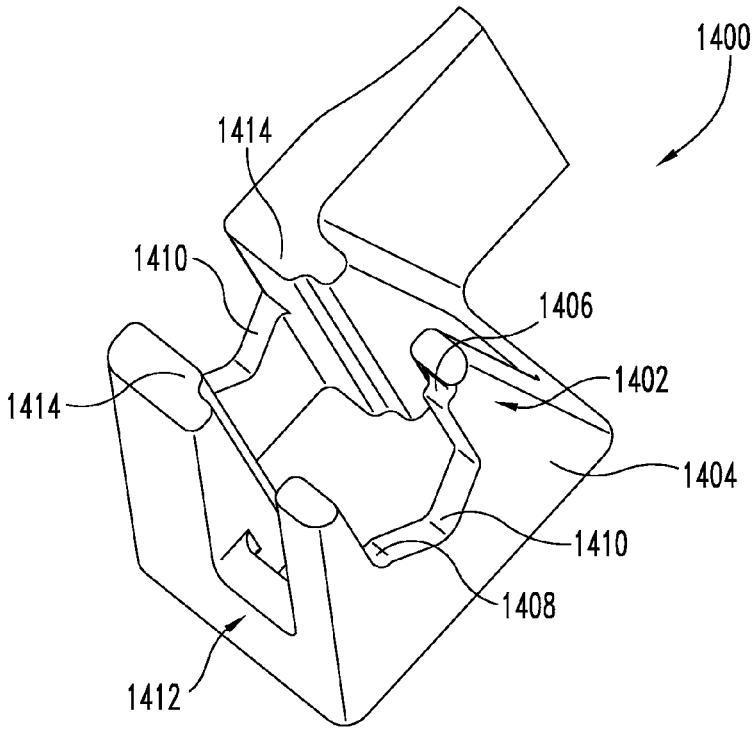

FIG. 14 is a perspective view of a second clip holder 1400. The second clip holder 1400, similar to the first clip holder 1300, can include a stop member 1402, a wall portion 1404 defining a stop surface 1406. Additionally, a flange receiving recess 1408, tube receiving area 1410, locking area 1412 and locking surface 1414 can appear similar to those in the first clip holder 1300.

The stop surface 1406 and flange receiving recess 1408 of the second clip holder 1400 can be in an orientation different from the stop surface 1306 and flange receiving recess 1308 of the first clip holder 1300 so as to prevent loading of the first clip 400 into the second clip holder 1400. Additionally and/or alternatively, the stop surface 1414 of the second clip holder 1400, similar to the stop surface 1314 of the first clip holder 1300, can be arranged to prevent loading of the second clip 500 into the second clip holder 1400 in an undesired orientation and/or prevent loading in any orientation of the first clip 400 into the second clip holder 1400.

Figure 15:
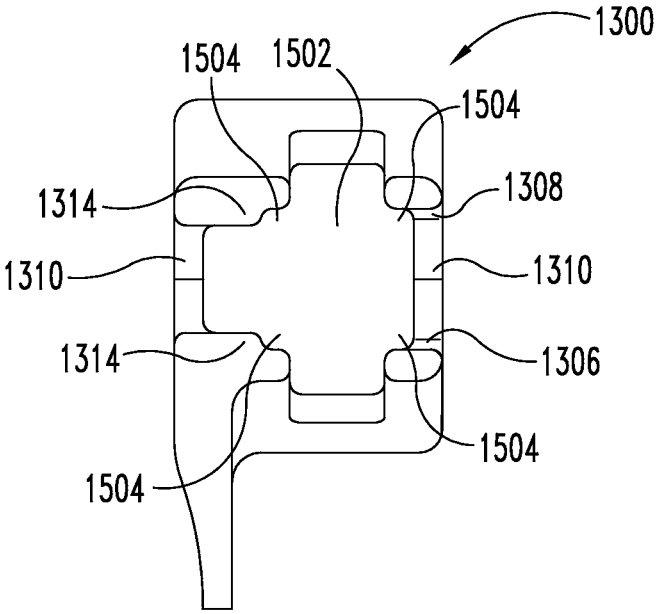
FIGS. 15 and 16 are top views of clip holders.
Figure 16:
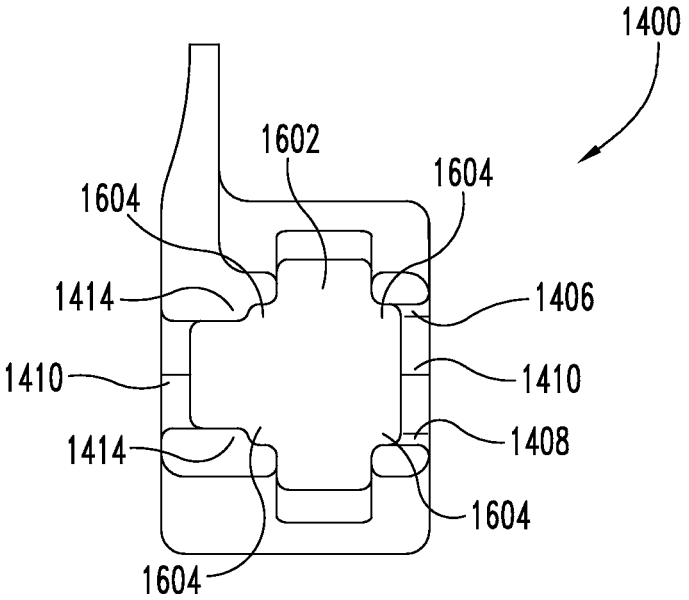

FIGS. 15 and 16 illustrate top views of the first clip holder 1300 and the second clip holder 1400, respectively. The first clip holder 1300 can define a clip recess 1502 arranged to receive a first clip 400 and the second clip holder 1400 can define a clip recess 1602 arranged to receive a second clip 500. The first clip holder 1300 can also include a guide receiving groove 1504 arranged to receive a guide portion 412 of a first clip 400. Similarly, the second clip holder 1400 can include a guide receiving groove 1604 arranged to receive a guide portion 512 of the second clip 500. The guide receiving groove 1504 and guide receiving groove 1604 can cooperate with the guide portion 412 of the first clip 400 and the guide portion 512 of the second clip. In some embodiments, the guide portions 412 and/or the guide portion 512 are arranged to maintain a predefined orientation of the first clip 400 to the first clip holder 1300 and/or the second clip 500 to the second clip holder 1400.

The guide portion 412 cooperates with the guide recess groove 1504 of the first clip holder 1300 so as to maintain alignment of the tube receiving area 402 of the first clip 400 with tube receiving area 1310 of the first clip holder 1300. The guide portion 512 of the second clip 500 cooperates with the guide receiving groove 1604 of the second clip holder 1400 so as to maintain alignment of the tube receiving area 502 of the second clip 500 with the tube receiving area 1410 of the second clip holder 1400.

Figure 17:
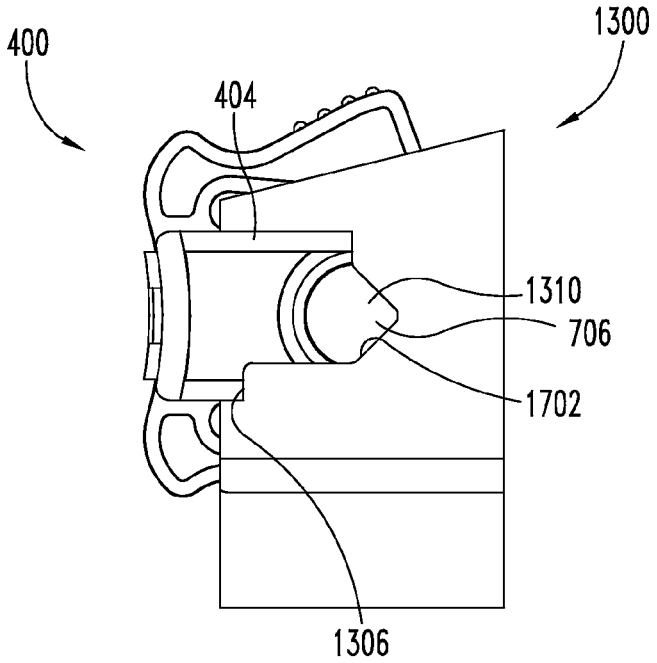
FIGS. 17 and 18 are side views of clip holders.
Figure 18:
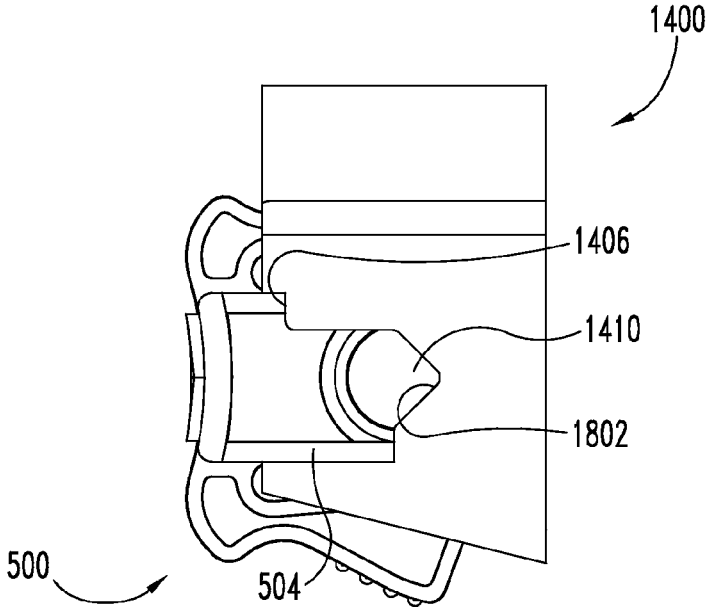

FIGS. 17 and 18 illustrate side views of assemblies of the first clip 400 in the first clip holder 1300 and the second clip 500 in the second clip holder 1400. The tube receiving area 1310 of the first clip holder 1300 is defined by a surface 1702. Similarly, the tube receiving area 1410 of the second clip holder 1400 is defined by a surface 1802.

The first clip holder 1300 and/or second clip holder 1400 may also have a tube deflecting portion such as, in some instances, the surface 1702 and/or the surface 1802. For example, some arrangements of the tube receiving area 1310 defined by the surface 1702 cover a portion of the recess 706 of the first clip 400. In these embodiments, when the first clip 400 retaining a fluid-carrying tube 122 is inserted into the first clip holder 1300, the surface 1702 and surface 704 of the first clip 400 can contort and/or compress the fluid-carrying tube 122. The same can be true for embodiments in which the surface 1802 is a tube deflecting portion. Additionally, some arrangements of the tube receiving area 1310 can have a smaller maximum outer dimension than the recess 706 of the first clip 400. Compression and/or contortion of the fluid-carrying tube 122 can aid in preventing migration of the fluid-carrying tube 122 during pumping operation and/or under non-pumping force exerted onto the tube 122 and/or the first clip 400.

In some embodiments, the cooperation of the first clip holder 1300 with the first clip 400 and/or the second clip holder 1400 with the second clip 500 is arranged so as to cause a predetermined amount of compression and/or contortion of the fluid-carrying tube 122 by the tube deflecting portion and the first clip 400 and/or second clip 500. Arranging the first clip holder 1300 and the first clip 400 and/or the second clip holder 1400 and the second clip 500 to impart a predetermined degree of compression and/or contortion on the fluid-carrying tube 122 can provide improved consistency in the securing of the fluid-carrying tube 122 to the peristaltic pump 100, which may decrease the likelihood of migration of the fluid-carrying tube 122 and/or decreased pumping operation.

When the first clip 400 is mated with the first clip holder 1300, the flange 404 of the first clip 400 resides within the flange receiving recess 1308 of the first clip holder 1300. Similarly, when the second clip 500 is mated with the second clip holder 1400, the flange 504 of the second clip 500 is received within the flange receiving recess 408 of the second clip holder 1400.

If the first clip 400 were to be inserted into the second clip holder 1400 in the same orientation as the second clip 500 is inserted in FIG. 18, the flange 404 of the first clip 400 would contact the stop surface 1406 of the second clip holder 1400 and prevent mating of the first clip 400 with the second clip holder 1400. Similarly, if the second clip 500 were to be inserted into the first clip holder 1300 in the same orientation as the first clip 400 is inserted in FIG. 17, the flange 504 of the second clip 500 would contact the stop surface 1306 of the first clip holder 1300 and prevent mating of the second clip 500 with the first clip holder 1300. This arrangement can be beneficial because it may prevent a user from loading a tube in an undesired orientation, e.g., in a reverse orientation, and therefore prevent the flow of fluid through the fluid-carrying tube 122 in an unintended direction. In some instances, the arrangement allows the fluid-carrying tube 122 and first and second clips 400 and 500 to be inserted in only a single orientation.

Figure 19:
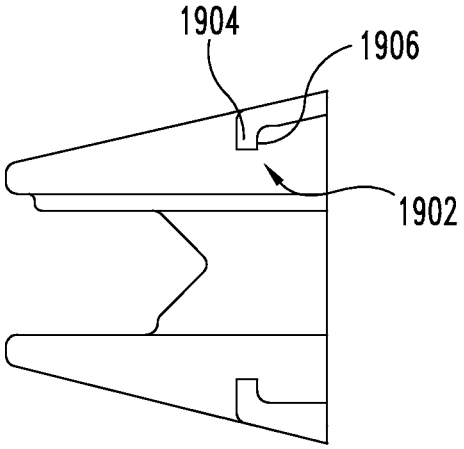
FIG. 19 is a side cut-away view of a clip holder.

FIG. 19 is a side cut-away view of a clip holder (such as the first clip holder 1300 and/or the second clip holder 1400). The first clip holder 1300 and/or the second clip holder 1400 can include a locking area 1902. The locking area can comprise an extending portion 1904 that has a surface 1906 arranged to contact a catch 406 of the first clip 400 or a catch 506 of a second clip 500 when the first clip 400 is inserted into the first clip holder 1300 and/or the second clip 500 is inserted into the second clip holder 1400. The locking area 1902 prevents withdrawal of the first clip 400 from the first clip holder 1300 after the first clip 400 has been mated with the first clip holder 1300. Similarly, the locking area 1902 prevents withdrawal of the second clip 500 from the second clip holder 1400 after the second clip 500 has been mated with the second clip holder 1400.

Figure 20:
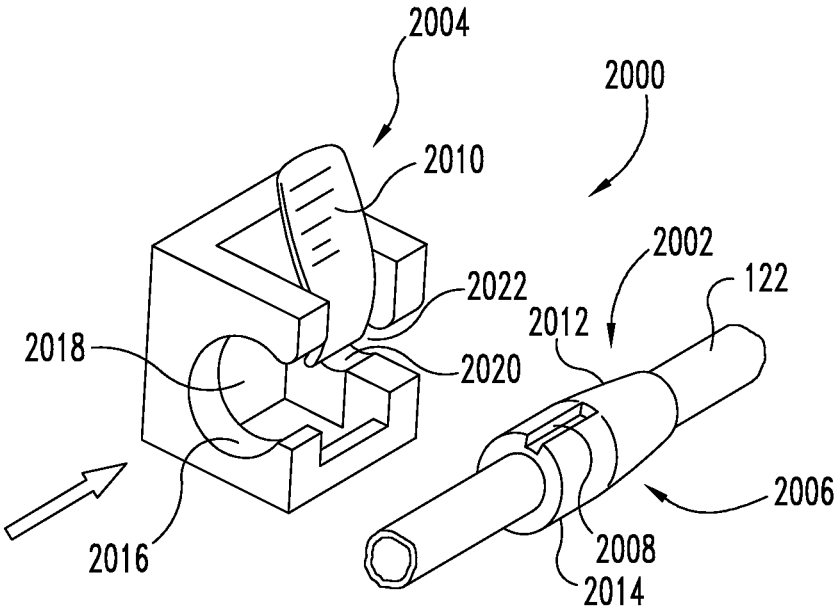
FIG. 20 is another embodiment of a mating member and mounting area system.

FIG. 20 illustrates an alternative embodiment of a system 2000 comprising a mating member 2002 retaining a fluid-carrying tube 122 and a mounting area 2004. The mating member can include a collar 2006 positioned around a fluid-carrying tube 122 and a groove 2008 arranged to cooperate with a locking member 2010 of the mounting area 2004. The collar 2006 can comprise a reduced portion 2012 and a locking member receiving portion 2014 containing the groove 2008.

The reduced portion 2012 can be tapered so as to permit insertion of the mating member 2002 holding a fluid-carrying tube 122 into the mounting area 2004, such as along the direction indicated by the arrow in FIG. 20. Tapering of the reduced portion 2012 can also be done to facilitate a resistance to migration of the fluid-carrying tube 122 retained by the mating member 2002 during pump operation and/or during a non-pumping force being exerted upon the tube and/or the mating member 2002. For example, the fluid-carrying tube 122 retained by the mating member 2002 can be inserted into the mounting area 2004 along the direction of the arrow shown in FIG. 20 with the reduced portion 2012 of the mating member 2002 passing through a first recess 2018 defined by the first wall 2016 and through a second recess 2022 defined by the second wall 2020, such that the reduced portion 2012 resides within the second recess 2022 and the locking member receiving portion 2014 having the groove 2008 is positioned within the mounting area 2004 and cooperates with the locking member 2010 to prevent movement of the mating member 2002 with respect of the mounting area 2004.

Figure 21:
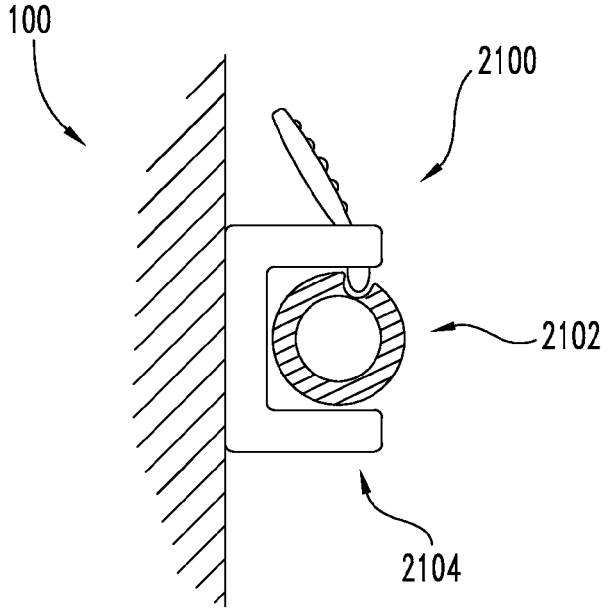
FIG. 21 is another embodiment of a mating member and mounting area system.
Figure 22:
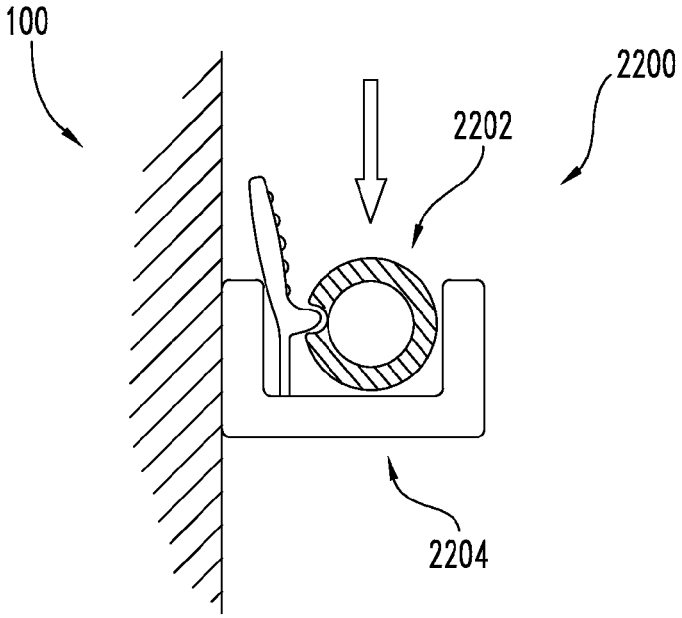
FIG. 22 is another embodiment of a mating member and mounting area system.

FIGS. 21 and 22 illustrate alternative arrangements of a mating member and mounting area. The system 2100 shown in FIG. 21 illustrates a mating member 2102 mated with a mounting area 2104. The mating member 2102 is brought into mating contact with the mounting area 2104 through movement along a direction toward the peristaltic pump 100. In comparison, the mating member 2202 and mounting area 2204 shown in system 2200 in FIG. 22 illustrate the mating member 2202 being brought into mating contact with the mounting area 2204 along a direction parallel to the peristaltic pump 100, as illustrated by the arrow in FIG. 22.

Figure 23:
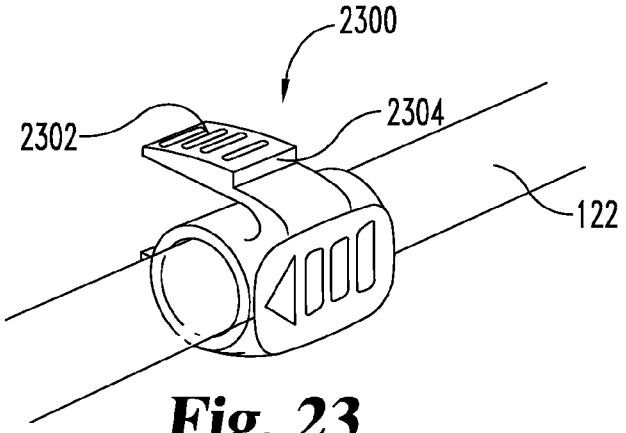
FIG. 23 is a perspective view of an alternative embodiment of a clip.
Figure 24:
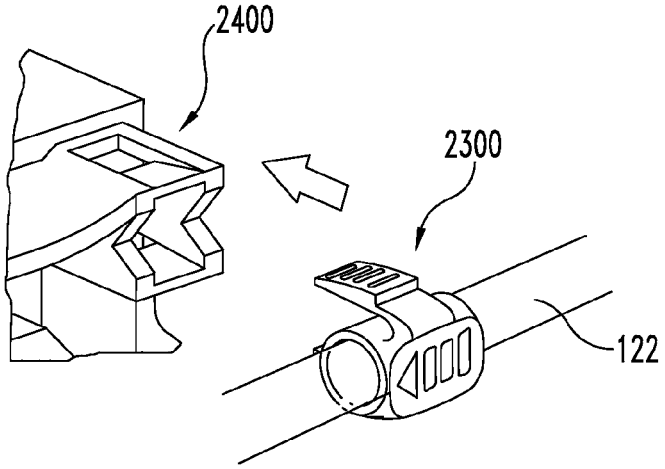
FIG. 24 is a perspective view of an alternative embodiment of a clip and a clip holder.
Figure 25:
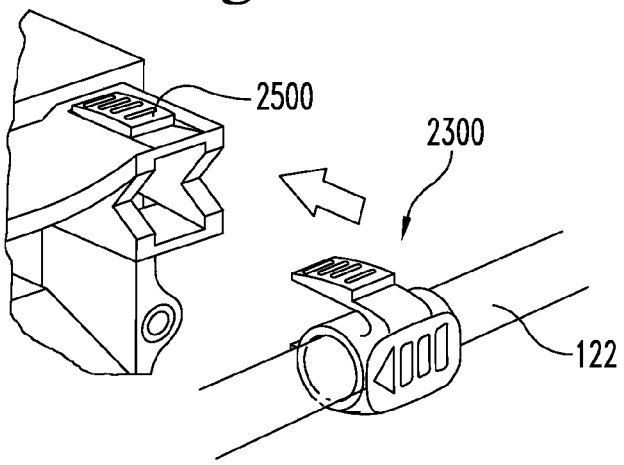
FIG. 25 is a perspective view of an alternative embodiment of a clip and a clip holder.

FIGS. 23, 24, and 25 illustrate alternative embodiments of mating members and mounting areas. The mating member 2300 shown in FIGS. 23, 24, and 25 has a tab portion 2302. The tab portion 2302 can comprise an edge portion 2304 that is arranged to cooperate with a surface on the mounting area 2400 so as to prevent withdrawn of the mating member 2300 from mating contact with the mounting area 2400. In some embodiments, the mounting area 2400 can further include a control 2500 such as a button to permit a user to more easily couple and/or decouple the mating member 2300 from the mounting area 2400. For example, the control 2500 can depress the tab portion 2302 having the edge portion 2304, so that the edge portion 2304 is removed from cooperation from a surface of the mounting area 2400, thus permitting the mating member 2300 to be removed from mating contact with the mounting area 2400.

Figure 26:
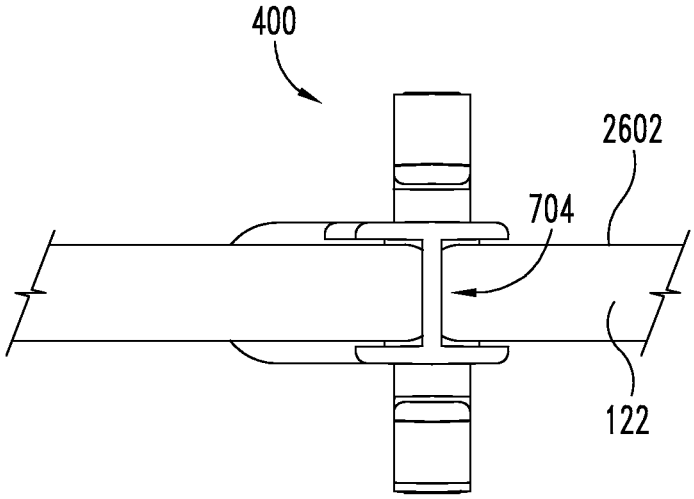
FIG. 26 is a back view of a clip retaining a fluid-carrying tube.

FIG. 26 illustrates a back view of first clip 400 with a fluid-carrying tube 122 inserted into the recess 706 defined by the surface 704 of the first clip 400. In some embodiments the recess 706 defined by the surface 704 of the first clip 400 is smaller than the maximum outer dimension of the fluid-carrying tube 122 as defined by the outer surface 2602 of the fluid-carrying tube 122. This can cause an interference fit between the fluid-carrying tube 122 and the first clip 400. In some instances the fluid-carrying tube 122 is compressed within the recess 706 of the first clip 400.

Figure 27:
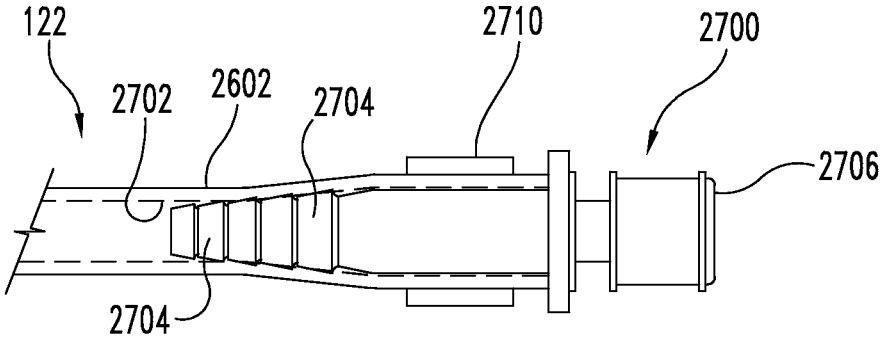
FIG. 27 is a side view of a fluid-carrying tube end region and a connector.

FIG. 27 illustrates an end region of a fluid-carrying tube 122. The fluid-carrying tube 122 having a barbed connector 2700 inserted into the inner lumen defined by the inner surface 2702 of the fluid-carrying tube 122 such that the barbed connector 2700 is in contact with the inner surface 2702 of the fluid-carrying tube 122. The barbed connector 2700 can have a connecting portion 2706 arranged to fluidly connect the fluid-carrying tube 122 with another device such as a catheter, needle, bag, etc.

The barbed connector can have a plurality of frusto-conical segments 2704 of the same or different size. In some instances, one or more frusto-conical segments 2704 of the barbed connector 2700 can have a maximum outer dimension significantly larger in size than the lumen defined by the inner surface 2702 of the fluid-carrying tube 122. In these instances, the barbed connector 2700 can expand the fluid-carrying tube 122 such that the maximum outer dimension of the outer surface 2602 of the fluid-carrying tube 122 in the region of the barbed connector 2700 is greater than the maximum outer dimension at other locations along the fluid-carrying tube 122. In some embodiments, the frusto-conical segments 2704 of the barbed connector 2700 and/or the expanded portion of the fluid-carrying tube 122 are/is larger than the recess 706 in the first clip 400 and/or the second clip 500 and thus prevents the first clip 400 and/or second clip 500 from being slidably removed over the end of the fluid-carrying tube 122, when the barbed connector 2700 is inserted therein.

In some embodiments, a securing collar 2710 is positioned on the outer surface of the fluid-carrying tube 122 and is arranged to compress a portion of the fluid-carrying tube 122 between an inner surface of the securing collar 2710 and a component positioned within the lumen of the fluid-carrying tube 122, e.g., barbed connector 2700. In some instances, the inner surface of securing collar 2710 corresponds with the outer surface of the component within the lumen such that the interference and/or frictional resistance between the wall of the fluid-carrying tube 122 and the component is greater than that without the securing collar 2710. For example, the inner surface of securing collar 2710 may have a portion that matches and/or mates with a barbed portion of the barbed connector.

Figure 28:
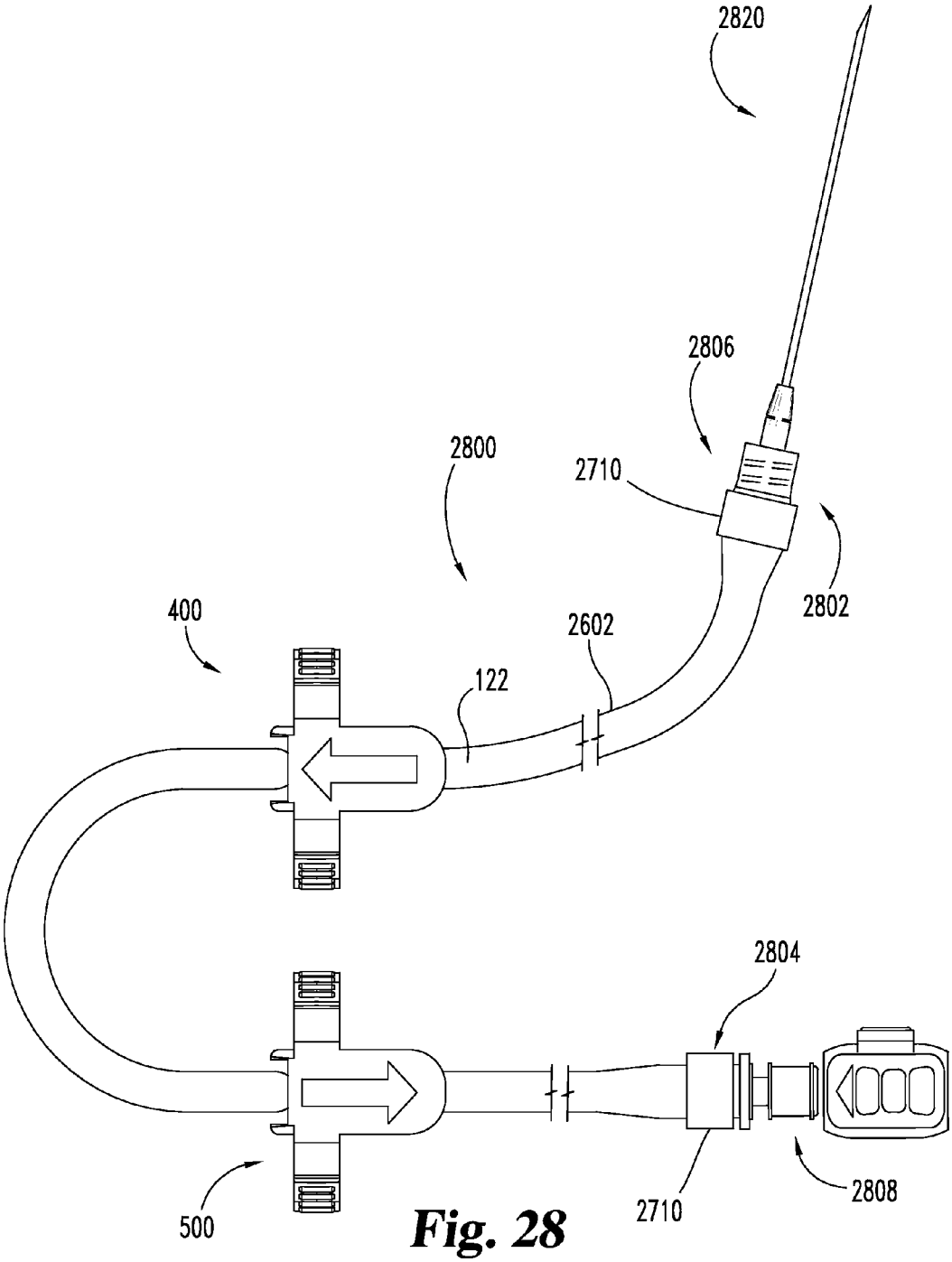
FIG. 28 illustrates a tubing, clip, and connector assembly.

FIG. 28 illustrates an arrangement 2800 of a fluid-carrying tube 122 having a first end region 2802 and a second end region 2804. In some embodiments, the first end region 2802 can have a first connector 2806 and the second end region 2804 can have a second connector 2808. Additionally, the first connector 2806 and the second connector 2808 can be of the same or of a different type and/or gender and/or arranged to connect to different accessories. For example the first connector 2806 can be of the Luer Lock type with the second connector 2808 being of the Foley type. In other embodiments, the first connector 2806 and the second connector 2808 are of different gender. For example, the first connector 2806 can be a male connector and the second connector 2808 can be a female connector. Additionally, the first connector 2806 can be arranged so as to not connect with the second connector 2808 or with a device that would connect with the second connector 2808, and/or vice-versa.

Positioned on the tube between the first end region 2802 (possibly including the first connector 2806) and the second end region 2804 (possibly including the second connector 2808) are a first clip 400 and a second clip 500. The first clip 400 and the second clip 500 can be slidably coupled to the fluid-carrying tube 122 so as to permit repositioning of the first clip 400 and/or second clip 500 along the length of the fluid-carrying tube 122.

In some instances, the various arrangements described above and/or illustrated in FIG. 28 can be sold as a kit, and the kit can include the fluid-carrying tube 122, the first clip 400, the second clip 500 and/or the first and/or second connectors 2806, 2808. The kit can also include one or more needles 2820, bags, catheters, guide wires, introducers and/or any other device that can be used in combination with the peristaltic pump and the fluid-carrying tube 122. For example, the kit may include a centesis catheter needle, such as the Yueh Centesis Disposable Catheter Needle™ by Cook Urological, Inc. In some instances, portions of the above kits may be pre-loaded/pre-connected on/to the tubing.

Kits may be formed in fluid drainage and/or fluid infusion configurations. For example, a kit may be packaged and/or sold as a fluid drainage kit with the first clip 400, the second clip 500, and at least one first connector 2806 and/or second connector 2808 connected to an end region of the tubing. In a fluid drainage configuration, the fluid may flow through the fluid-carrying tube in a direction from the first end region 2802, towards the first clip 400, around the rotor assembly 102, towards the second clip 500, and out of the second end region 2804. In this sort of configuration, the kit can include a first connector 2806 at the first end region 2802, the first connector 2806 being of the type that connects to a catheter, a cannula, and/or a needle that is insertable in a patient's body. Alternatively or in addition, the kit can include a second connector 2808 at the second end region 2804 of the fluid-carrying tube 122, the second connector 2808 being of the type that connects to a collection bag to collect fluids from the patient's body. A kit formed in a fluid infusion configuration may be similar to a kit formed in a fluid drainage configuration except with the first connector 2806 and/or the second connector 2808 reversed (e.g., the first connector 2806 positioned in the second end region 2804 and/or the second connector 2808 positioned in the first end region 2802) or the first and second clips 400 and 500 reversed (e.g., the second clip 500 being positioned between the first clip and the first end region 2802).

Figure 29:
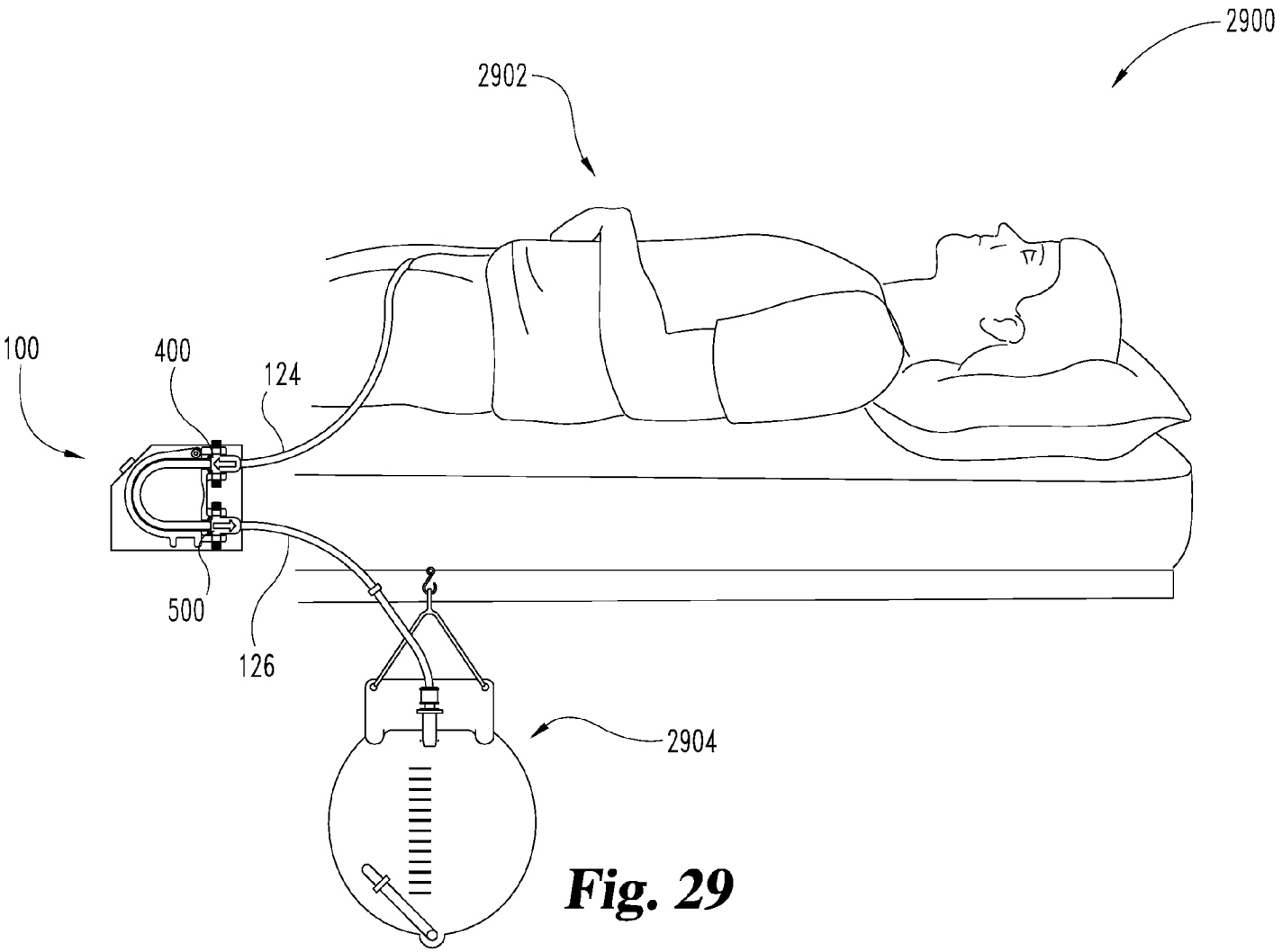
FIG. 29 illustrates a pump and tubing arrangement.

FIG. 29 illustrates an arrangement of a peristaltic pump 100, a fluid-carrying tube 122, a first clip 400, and a second clip 500. The arrangement 2900 in this figure illustrates the on application of the peristaltic pump 100 and tubing and clip assembly being used to withdraw fluid from a patient 2902 into a bag 2904.

Figure 30:
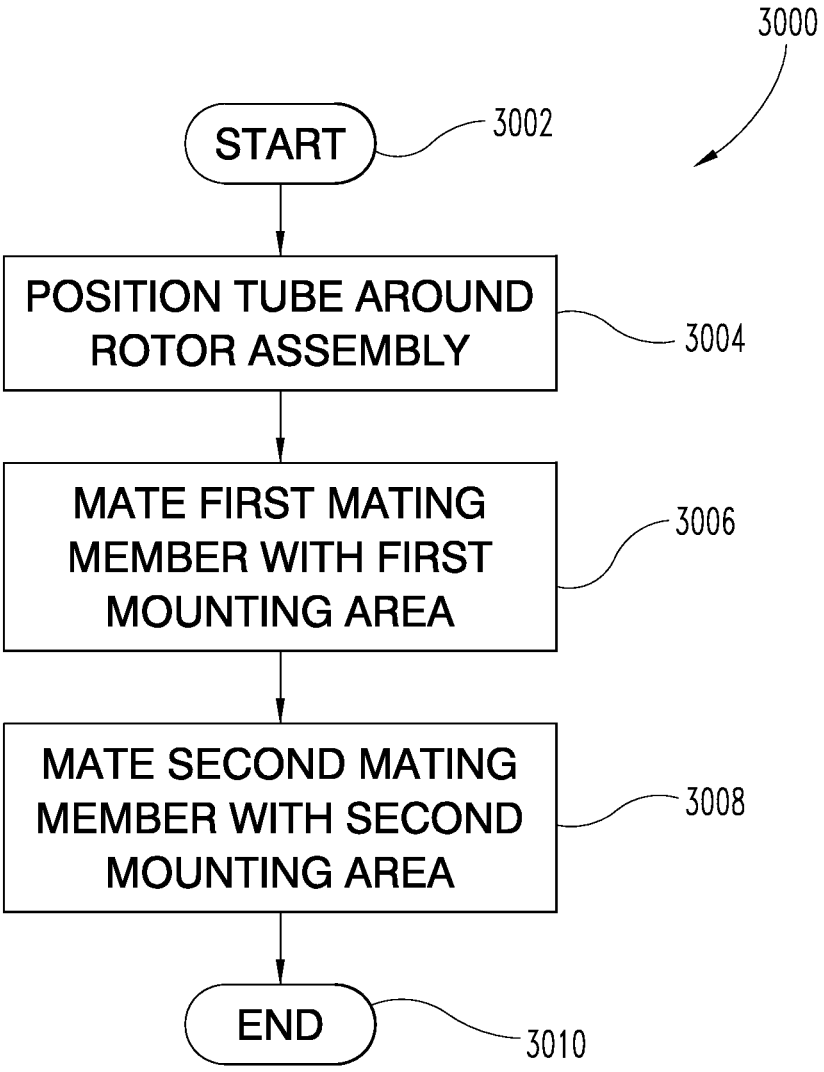
FIG. 30 is a flow chart illustrating one method of attaching a fluid-carrying tube to a peristaltic pump.

FIG. 30 illustrates a flow chart 3000 of a method of attaching a fluid-carrying tube to a peristaltic pump. In stage 3002, one can acquire a fluid-carrying tube and/or a peristaltic pump by, for example, purchasing a kit having these components from a manufacturer. In stage 3004, one can position the fluid-carrying tube around a rotor assembly of a peristaltic pump. In stage 3006, one can mate a first mating member retaining the fluid-carrying tube with a first mounting area of the peristaltic pump. In stage 3008, one can mate a second mating member retaining a fluid-carrying tube with a second mounting area of the peristaltic pump. In stage 3010, one can complete the process of attaching a fluid-carrying tube to a peristaltic pump by, for example, attaching a cover over the rotor assembly of the peristaltic pump and/or activating the peristaltic pump to transfer a fluid material through the inner lumen of the fluid-carrying tube.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

We claim:

1. A peristaltic pump, comprising:

a rotor assembly and a mounting arrangement associated with the rotor assembly;

said mounting arrangement having a first mounting area and a second mounting area;

said first mounting area being mateable with a first mating member having a fluid-carrying tube extending therethrough such that a length of the fluid-carrying tube extends beyond opposing sides of the first mating member;

said second mounting area being mateable with a second mating member having the fluid-carrying tube extending therethrough such that a length of the fluid-carrying tube extends beyond opposing sides of the second mating member; and at least one sensor positioned within at least one of said mounting areas and arranged to detect a sensor detectable feature of at least one of said mating members;

wherein said first mounting area is arranged to prevent said first mounting area from mating with the second mating member;

wherein said first mounting area includes a locking surface arranged to contact a catch of a deflectable tab member of the first mating member and resist withdrawal of the first mating member from the first mounting area when the catch is engaged with the locking surface; and wherein the first mating member is advanced along a first direction when mating the first mating member with the first mounting area and wherein the locking surface is transverse to said first direction.

2. The pump of claim 1, further comprising:

a stop member in said first mounting area that prevents said first mounting area from mating with the second mating member.

3. The pump of claim 1, wherein:

said sensor is coupled to internal circuitry of the peristaltic pump and is arranged to prevent operation of the pump when said sensor detectable feature is not detected.

4. The pump of claim 1, wherein:

said sensor detectable feature comprises a protrusion.

5. The pump of claim 1, wherein:

said first and second mating members are selectively adhereable to the fluid-carrying tube.

6. The pump of claim 1, wherein the rotor assembly rotates around a rotational axis and wherein the first direction is parallel to said rotational axis.

7. The pump of claim 1, further comprising:

a tube deflecting portion on said first mounting area wherein the fluid-carrying tube is contorted between said tube deflecting portion and the first mating member when said first mounting area is mated with the first mating member.

8. The pump of claim 1, wherein:

said second mounting area is arranged to prevent said second mounting area from mating with the first mating member.

9. The pump of claim 8, further comprising:

a stop member in said second mounting area that prevents said second mounting area from mating with the first mating member.

10. A kit useful for operably coupling a fluid-carrying tube with a peristaltic pump having a first and a second mounting areas, the kit comprising:

a first mating member arranged to mate with the first mounting area of the peristaltic pump; and a second mating member arranged to mate with the second mounting area of the peristaltic pump;

said first and second mating members arranged to retain the fluid-carrying tube; and said first mating member having an arrangement that prevents said first mating member from mating with the second mounting area of the peristaltic pump;

wherein said first and second mating members are slidably positionable along the fluid-carrying tube such that said first and second mating members can be slidably moved along a length of the fluid-carrying tube prior to said first and second mating members being mated with the first and second mounting areas of the peristaltic pump; and wherein said first and second mating members each include a deflectable tab member having a catch mounted thereon, the catch of each mating member arranged to engage a locking area of the respective mounting area mateable with the respective mating member and resist withdrawal of the mating member from the mounting area when engaged.

11. The kit of claim 10, wherein:

said first and second mating members are selectively adhereable to the fluid-carrying tube.

12. The kit of claim 10, wherein:

said second mating member has an arrangement that prevents said second mating member from mating with the first mounting area of the peristaltic pump.

13. The kit of claim 10, further comprising:

a flange of said first mating member that prevents mating with the second mounting area.

14. The kit of claim 10, further comprising:

a first connector for coupling a first end region of said tube.

15. The kit of claim 10, wherein:

said first and second mating members comprise sensor detectable features.

16. The kit of claim 15, wherein:

said sensor detectable features are arranged to interact with a sensor of the peristaltic pump so as to allow operation of the pump.

17. The kit of claim 10, wherein:

at least one of said mating members is arranged to surround the circumference of the fluid-carrying tube.

18. The kit of claim 17, wherein:

at least one of said mating members has a portion smaller in size than said fluid-carrying tube so as to cause an interference fit.

19. The kit of claim 14, further comprising:

a securing collar arranged to cooperate with the first connector to compress a wall portion of said first end region of said tube.

20. The kit of claim 14, further comprising:

a second connector for coupling a second end region of said tube.

21. The kit of claim 20, wherein:

said first and second mating members and said first and second connectors are preassembled on said tube.

22. The kit of claim 20, wherein:

said first connector and said second connector are of a different gender.

23. The kit of claim 20, wherein:

said first connector and said second connector are of a different type.

24. An assembly, comprising:

a peristaltic pump having a rotor assembly, a compression surface associated with said rotor assembly, and a first and a second mounting area; and a tube retaining member that is attachable and detachable from said first and said second mounting areas of said pump and arranged to retain a fluid-carrying tube;

wherein said pump is arranged to receive the fluid-carrying tube between said rotor assembly and said compression surface when said tube retaining member is attached;

wherein said tube retaining member is slidably positionable along the fluid-carrying tube such that said tube retaining member can be slidably moved along a length of the fluid-carrying tube prior to said tube retaining member being attached to the peristaltic pump;

wherein said tube retaining member includes a deflectable tab member having a catch mounted thereon, the catch of the tube retaining member arranged to engage a locking area of the corresponding mounting area mateable with the tube retaining member and resist withdrawal of the tube retaining member from the corresponding mounting area when engaged; and wherein the deflectable tab member is deflectable to move the catch out of engagement with a locking surface of the locking area so that the tube retaining member is removable from the corresponding mounting area.

25. The assembly of claim 24, wherein:

said tube retaining member is attachable to said peristaltic pump in only one orientation.

26. The assembly of claim 24, wherein the locking surface is transverse to the direction along which said tube retaining member is attachable and detachable from said first and second mounting areas.

27. The assembly of claim 24, wherein:

said tube retaining member is selectively adherable to the fluid-carrying tube.

28. The assembly of claim 27, wherein:

the tube retaining member comprises a sensor detectable feature arranged to be detected by at least one sensor of said peristaltic pump when the tube retaining member is attached to said first and second mounting areas.

29. The assembly of claim 28, wherein:

said detection of said sensor detectable feature by said sensor controls the operation of said peristaltic pump.

30. A method of attaching a fluid-carrying tube to a peristaltic pump, comprising:

positioning a portion of the fluid-carrying tube around a rotor of the peristaltic pump;

mating a first mating member with a first mounting area of the peristaltic pump; and mating a second mating member with a second mounting area of the peristaltic pump so as to attach the fluid-carrying tube to the peristaltic pump;

wherein each mating member is not mateable with the other mounting area; wherein said first and second mating members are slidably positionable along the fluid-carrying tube such that said first and second mating members can be slidably moved along a length of the fluid-carrying tube prior to said first and second mating members being mated with the first and second mounting areas of the peristaltic pump;

wherein mating the first mating member with the first mounting area includes deflecting a deflectable tab member of the first mating member to engage a catch mounted on the deflectable tab member of the first mating member with a locking surface of the first mounting area, the catch arranged to resist withdrawal of the first mating member from the first mounting area when engaged therein; and wherein mating the second mating member with the second mounting area includes deflecting a deflectable tab member of the second mating member to engage a catch mounted on the deflectable tab member of the second mating member with a locking surface of the second mounting area, the catch arranged to resist withdrawal of the second mating member from the second mounting area when engaged therein.

* * * * *